US011209195B2

(12) United States Patent
Kumakura et al.

(10) Patent No.: US 11,209,195 B2
(45) Date of Patent: Dec. 28, 2021

(54) AIR CONDITIONER WITH A REFRIGERANT HAVING A PROPERTY OF UNDERGOING DISPROPORTIONATION

(71) Applicant: Daikin Industries, LTD., Osaka (JP)

(72) Inventors: Eiji Kumakura, Osaka (JP); Tetsuya Okamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 142 days.

(21) Appl. No.: 16/492,730

(22) PCT Filed: Mar. 23, 2018

(86) PCT No.: PCT/JP2018/011820
§ 371 (c)(1),
(2) Date: Sep. 10, 2019

(87) PCT Pub. No.: WO2018/181038
PCT Pub. Date: Oct. 4, 2018

(65) Prior Publication Data

US 2021/0148611 A1 May 20, 2021

(30) Foreign Application Priority Data

Mar. 31, 2017 (JP) ..... JP2017-070184

(51) Int. Cl.
*F25B 13/00* (2006.01)
*F25B 49/02* (2006.01)
*F25B 41/20* (2021.01)

(52) U.S. Cl.
CPC ..... *F25B 13/00* (2013.01); *F25B 49/02* (2013.01); *F25B 41/20* (2021.01);
(Continued)

(58) Field of Classification Search
CPC ..... F25B 13/00; F25B 49/02; F25B 2500/06; F25B 2313/02741; F25B 2700/21152; F25B 41/20; F25B 2600/2513
See application file for complete search history.

(56) References Cited

U.S. PATENT DOCUMENTS

2007/0113568 A1* 5/2007 Jang ..... F25B 41/31 62/222
2007/0214829 A1* 9/2007 Otake ..... F28F 3/12 62/515
(Continued)

FOREIGN PATENT DOCUMENTS

CN 104566864 A 4/2015
EP 3 040 655 A1 7/2016
(Continued)

*Primary Examiner* — Henry T Crenshaw
(74) *Attorney, Agent, or Firm* — Birch, Stewart, Kolasch & Birch, LLP

(57) ABSTRACT

An air conditioner (1, 101) has a refrigerant circuit (10, 110) which is formed by connecting an outdoor unit (2, 102) and an indoor unit (3). The refrigerant circuit (10, 110) has a refrigerant sealed therein. The refrigerant contains a hydrofluorocarbon having a property of undergoing a disproportionation reaction. The refrigerant circuit (10, 110) includes a refrigerant shutoff mechanism (24, 41, 43, 46, 47, 48) that shuts off a flow of the refrigerant from the outdoor unit (2, 102) side to the indoor unit (3) side when the refrigerant in a portion of the refrigerant circuit (10, 110) within the outdoor unit (2, 102) meets a predetermined condition.

11 Claims, 11 Drawing Sheets

(52) U.S. Cl.
CPC . *F25B 2313/02741* (2013.01); *F25B 2500/06* (2013.01); *F25B 2600/2513* (2013.01); *F25B 2700/21152* (2013.01)

(56) References Cited

U.S. PATENT DOCUMENTS

| | | | | |
|---|---|---|---|---|
| 2014/0070132 | A1 | 3/2014 | Fukushima | |
| 2017/0003060 | A1* | 1/2017 | Tanaka | F25B 45/00 |
| 2017/0089616 | A1* | 3/2017 | Yamashita | F25B 31/002 |
| 2017/0138645 | A1* | 5/2017 | Sakima | F25B 41/20 |
| 2019/0032929 | A1* | 1/2019 | Maeyama | F24F 1/18 |

FOREIGN PATENT DOCUMENTS

| | | | |
|---|---|---|---|
| EP | 3 121 533 | A1 | 1/2017 |
| EP | 3 121 539 | A1 | 1/2017 |
| JP | 4-369370 | A | 12/1992 |
| JP | 5-118720 | A | 5/1993 |
| JP | 2000-28237 | A | 1/2000 |
| JP | 2015-214927 | A | 12/2015 |
| WO | WO 2012/157764 | A1 | 11/2012 |
| WO | WO 2015/083529 | A1 | 6/2015 |
| WO | WO 2015/136979 | A1 | 9/2015 |

* cited by examiner

AIR CONDITIONER WITH A REFRIGERANT HAVING A PROPERTY OF UNDERGOING DISPROPORTIONATION

TECHNICAL FIELD

The present invention relates to air conditioners.

BACKGROUND ART

Refrigerants such as HFC-32 (difluoromethane) and HFC-410A, which is a mixture of HFC-32 and HFC-125 (pentafluoroethane), are conventionally used as refrigerants sealed in the refrigerant circuits of air conditioners to prevent the destruction of the ozone layer. However, these refrigerants have a problem in that they have high global warming potentials (GWPs).

In contrast, refrigerants containing HFO-1123 (1,1,2-trifluoroethylene), which are disclosed in PTL 1 (International Publication No. 2012/157764), are known to have less effect on the ozone layer and global warming. PTL 1 discloses that such a refrigerant is sealed into a refrigerant circuit to constitute an air conditioner.

SUMMARY OF THE INVENTION

However, the refrigerants disclosed in PTL 1 have the property of undergoing a disproportionation reaction (self-decomposition reaction) when given some energy under high-pressure and high-temperature conditions. A disproportionation reaction of a refrigerant in a refrigerant circuit results in a rapid pressure and temperature rise. In an air conditioner in which an outdoor unit and an indoor unit are connected, a disproportionation reaction tends to occur in a portion of the refrigerant circuit within the outdoor unit. If such a disproportionation reaction occurs one after another, the disproportionation reaction and the resulting pressure rise may propagate from the outdoor unit side to the indoor unit side and may thus cause the refrigerant to be ejected into the indoor space.

An object of the present invention is to reduce the likelihood that an air conditioner having a refrigerant circuit in which a refrigerant containing a hydrofluorocarbon having the property of undergoing a disproportionation reaction causes the refrigerant to be ejected into the indoor space when the refrigerant undergoes a disproportionation reaction.

An air conditioner according to a first aspect has a refrigerant circuit which is formed by connecting an outdoor unit and an indoor unit. A refrigerant containing a hydrofluorocarbon having a property of undergoing a disproportionation reaction is sealed in the refrigerant circuit. Here, the refrigerant circuit includes a refrigerant shutoff mechanism that shuts off the flow of the refrigerant from the outdoor unit side to the indoor unit side when the refrigerant in a portion of the refrigerant circuit within the outdoor unit meets a predetermined condition.

Here, the air conditioner includes the refrigerant shutoff mechanism as described above. Therefore, when a disproportionation reaction occurs in the portion of the refrigerant circuit within the outdoor unit, the refrigerant shutoff mechanism can shut off the flow of the refrigerant from the outdoor unit side to the indoor unit side so as to inhibit the propagation of the disproportionation reaction and the resulting pressure rise to the indoor unit.

Thus, here, even when the refrigerant undergoes a disproportionation reaction, a likelihood that the devices and pipes that constitute a portion of the refrigerant circuit within the indoor unit is damaged can be reduced, thereby reducing the likelihood of the refrigerant being ejected into the indoor space.

An air conditioner according to a second aspect is the air conditioner according to the first aspect, in which the outdoor unit includes a compressor and an outdoor heat exchanger, and the indoor unit includes an indoor heat exchanger. The refrigerant circuit is configured to circulate the refrigerant through, in sequence, the compressor, the outdoor heat exchanger, the indoor heat exchanger, and the compressor. Here, the refrigerant shutoff mechanism includes a gas-side refrigerant shutoff mechanism that shuts off the flow of the refrigerant from the intake side of the compressor to the indoor unit side and a liquid-side refrigerant shutoff mechanism that shuts off the flow of the refrigerant from the liquid side of the outdoor heat exchanger to the indoor unit side.

Here, the refrigerant circuit is configured to circulate the refrigerant through, in sequence, the compressor, the outdoor heat exchanger, the indoor heat exchanger, and the compressor (cooling operation). Therefore, when a disproportionation reaction occurs in the portion of the refrigerant circuit within the outdoor unit, it is necessary to shut off the flow of the refrigerant from the intake side of the compressor to the indoor unit side and the flow of the refrigerant from the liquid side of the outdoor heat exchanger to the indoor unit side.

Accordingly, here, the gas-side refrigerant shutoff mechanism and the liquid-side refrigerant shutoff mechanism as described above are provided as refrigerant shutoff mechanisms in the refrigerant circuit.

Thus, here, when a disproportionation reaction occurs in the portion of the refrigerant circuit within the outdoor unit while the refrigerant is being circulated in the refrigerant circuit through, in sequence, the compressor, the outdoor heat exchanger, the indoor heat exchanger, and the compressor, the gas-side refrigerant shutoff mechanism and the liquid-side refrigerant shutoff mechanism can shut off the flow of the refrigerant from the outdoor unit side to the indoor unit side.

An air conditioner according to a third aspect is the air conditioner according to the second aspect, in which the gas-side refrigerant shutoff mechanism is a check valve.

Here, as described above, the gas-side refrigerant shutoff mechanism is a check valve. The check valve therefore can shut off the flow of the refrigerant from the intake side of the compressor to the indoor unit side without electrical control.

An air conditioner according to a fourth aspect is the air conditioner according to the first aspect, in which the outdoor unit includes a compressor and an outdoor heat exchanger, and the indoor unit includes an indoor heat exchanger. The refrigerant circuit is configured to circulate the refrigerant through, in sequence, the compressor, the indoor heat exchanger, the outdoor heat exchanger, and the compressor. Here, the refrigerant shutoff mechanism includes a gas-side refrigerant shutoff mechanism that shuts off the flow of the refrigerant from the discharge side of the compressor to the indoor unit side and a liquid-side refrigerant shutoff mechanism that shuts off the flow of the refrigerant from the liquid side of the outdoor heat exchanger to the indoor unit side.

Here, the refrigerant circuit is configured to circulate the refrigerant through, in sequence, the compressor, the indoor heat exchanger, the outdoor heat exchanger, and the compressor (heating operation). Therefore, when a disproportionation reaction occurs in the portion of the refrigerant circuit within the outdoor unit, it is necessary to shut off the flow of the refrigerant from the discharge side of the compressor to the indoor unit side and the flow of the refrigerant from the liquid side of the outdoor heat exchanger to the indoor unit side.

Accordingly, here, the gas-side refrigerant shutoff mechanism and the liquid-side refrigerant shutoff mechanism as described above are provided as refrigerant shutoff mechanisms in the refrigerant circuit.

Thus, here, when a disproportionation reaction occurs in the portion of the refrigerant circuit within the outdoor unit while the refrigerant is being circulated in the refrigerant circuit through, in sequence, the compressor, the indoor heat exchanger, the outdoor heat exchanger, and the compressor, the gas-side refrigerant shutoff mechanism and the liquid-side refrigerant shutoff mechanism can shut off the flow of the refrigerant from the outdoor unit side to the indoor unit side.

An air conditioner according to a fifth aspect is the air conditioner according to the second or fourth aspect, in which the gas-side refrigerant shutoff mechanism is an electromagnetic valve.

Here, as described above, the gas-side refrigerant shutoff mechanism is an electromagnetic valve. Therefore, when the refrigerant in the portion of the refrigerant circuit within the outdoor unit meets the predetermined condition, the electromagnetic valve can be closed by electrical control to shut off the flow of the refrigerant from the intake side of the compressor or the discharge side of the compressor to the indoor unit side.

An air conditioner according to a sixth aspect is the air conditioner according to any one of the second to fifth aspects, in which the liquid-side refrigerant shutoff mechanism is an expansion valve that decompresses the refrigerant flowing between the outdoor heat exchanger and the indoor heat exchanger.

Here, as described above, the liquid-side refrigerant shutoff mechanism is the expansion valve. The expansion valve is used for decompression while the refrigerant is being circulated in the refrigerant circuit. When the refrigerant in the portion of the refrigerant circuit within the outdoor unit meets the predetermined condition, the expansion valve can be closed by electrical control to shut off the flow of the refrigerant from the liquid side of the outdoor heat exchanger to the indoor unit side.

An air conditioner according to a seventh aspect is the air conditioner according to any one of the first to sixth aspects, in which the refrigerant circuit further includes a refrigerant relief mechanism that releases the refrigerant out of the refrigerant circuit when the refrigerant in the portion of the refrigerant circuit within the outdoor unit meets a predetermined condition.

Here, as described above, a refrigerant relief mechanism is further provided in addition to the refrigerant shutoff mechanism. Thus, when a disproportionation reaction occurs, the refrigerant shutoff mechanism can shut off the flow of the refrigerant from the outdoor unit side to the indoor unit side, and the refrigerant relief mechanism can release the refrigerant out of the refrigerant circuit.

Thus, here, the propagation of the disproportionation reaction and the resulting pressure rise to the indoor unit can be further inhibited.

An air conditioner according to an eighth aspect is the air conditioner according to the seventh aspect, in which the outdoor unit includes a compressor, and the refrigerant relief mechanism is a relief valve disposed on the discharge side of the compressor.

An air conditioner according to a ninth aspect is the air conditioner according to the seventh aspect, in which the outdoor unit includes a compressor, and the refrigerant relief mechanism is a terminal cover covering a terminal portion of the compressor.

An air conditioner according to a tenth aspect is the air conditioner according to the seventh aspect, in which the outdoor unit includes an outdoor heat exchanger, and the refrigerant relief mechanism is a protective cover covering a brazed portion of the outdoor heat exchanger.

An air conditioner according to an eleventh aspect is the air conditioner according to any one of the first to tenth aspects, in which the refrigerant contains HFO-1123.

HFO-1123 is a hydrofluorocarbon having the property of undergoing a disproportionation reaction and has properties, such as boiling point, close to those of HFC-32 and HFC-410A. Thus, a refrigerant containing HFO-1123 can be used as an alternative refrigerant to HFC-32 or HFC-410A.

Thus, here, a refrigerant containing HFO-1123 is used as an alternative refrigerant to HFC-32 or HFC-410A. Even when the refrigerant undergoes a disproportionation reaction, the likelihood that the portion of the refrigerant circuit within the indoor unit is damaged can be reduced, thereby reducing the likelihood of the refrigerant being ejected into the indoor space.

DESCRIPTION OF EMBODIMENTS

Embodiments of air conditioners according to the present invention will hereinafter be described with reference to the drawings. The specific configurations of the embodiments of the air conditioners according to the present invention are not limited to the following embodiments and modifications thereof, but can be changed without departing from the spirit of the present invention.

(1) First Embodiment

Figure 1:
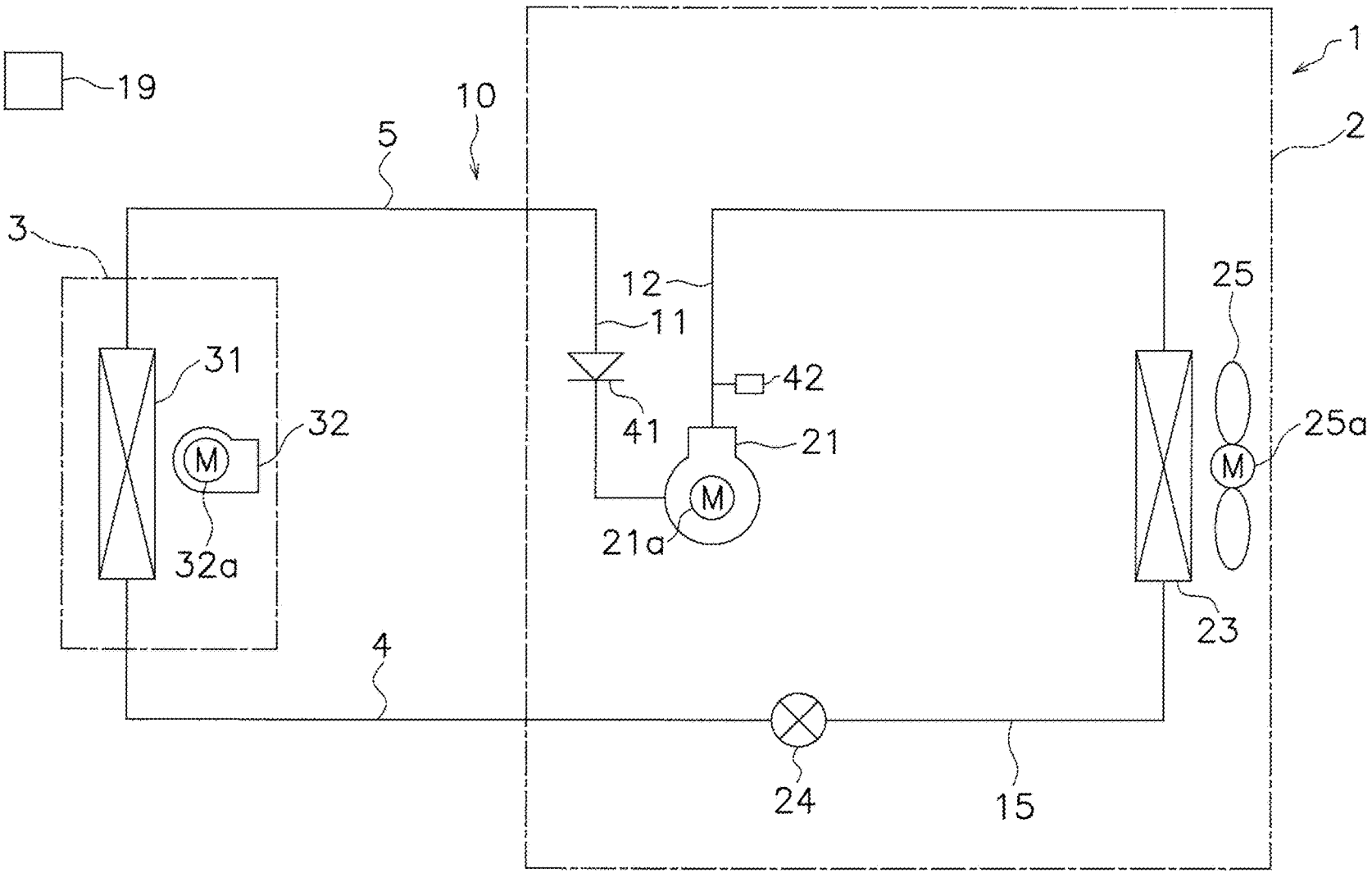
FIG. 1 is a schematic diagram of an air conditioner according to a first embodiment of the present invention.

FIG. 1 is a schematic diagram of an air conditioner 1 according to a first embodiment of the present invention.

<Basic Configuration>

—Overall Apparatus—

The air conditioner 1 is an apparatus capable of cooling the indoor space of a building or other place through a vapor-compression refrigeration cycle. The air conditioner 1 mainly includes an outdoor unit 2, an indoor unit 3, a liquid-refrigerant connection pipe 4 and a gas-refrigerant connection pipe 5 that connect the outdoor unit 2 and the indoor unit 3 together, and a control unit 19 that controls the devices that constitute the outdoor unit 2 and the indoor unit 3. The outdoor unit 2 and the indoor unit 3 are connected together via the refrigerant connection pipes 4 and 5 to form a vapor-compression refrigerant circuit 10 of the air conditioner 1.

—Indoor Unit—

The indoor unit 3 is installed indoors and constitutes part of the refrigerant circuit 10. The indoor unit 3 mainly includes an indoor heat exchanger 31 and an indoor fan 32.

The indoor heat exchanger 31 is a heat exchanger that exchanges heat between indoor air and the refrigerant circulated between the indoor unit 3 and the outdoor unit 2 through the liquid-refrigerant connection pipe 4 and the gas-refrigerant connection pipe 5. A liquid side of the indoor heat exchanger 31 is connected to the liquid-refrigerant connection pipe 4, whereas a gas side of the indoor heat exchanger 31 is connected to the gas-refrigerant connection pipe 5.

The indoor fan 32 is a fan that blows indoor air to the indoor heat exchanger 31. The indoor fan 32 is driven by an indoor fan motor 32*a*.

—Outdoor Unit—

The outdoor unit 2 is installed outdoors and constitutes part of the refrigerant circuit 10. The outdoor unit 2 mainly includes a compressor 21, an outdoor heat exchanger 23, an expansion valve 24, and an outdoor fan 25.

The compressor 21 is a device for compressing the refrigerant. For example, the compressor 21 is a compressor in which a positive-displacement compression element (not shown) is driven to rotate by a compressor motor 21*a*. An intake pipe 11 is connected to an intake side of the compressor 21, whereas a discharge pipe 12 is connected to a discharge side of the compressor 21. The intake pipe 11 is connected to the gas-refrigerant connection pipe 5.

The outdoor heat exchanger 23 is a heat exchanger that exchanges heat between outdoor air and the refrigerant circulated between the indoor unit 3 and the outdoor unit 2 through the liquid-refrigerant connection pipe 4 and the gas-refrigerant connection pipe 5. A liquid side of the outdoor heat exchanger 23 is connected to a liquid refrigerant pipe 15, whereas a gas side of the outdoor heat exchanger 23 is connected to the discharge pipe 12. The liquid refrigerant pipe 15 is connected to the liquid-refrigerant connection pipe 4.

The expansion valve 24 is an electric valve that decompresses the refrigerant and is disposed in the liquid refrigerant pipe 15.

The outdoor fan 25 is a fan that blows outdoor air to the outdoor heat exchanger 23. The outdoor fan 25 is driven by an outdoor fan motor 25*a*.

The outdoor unit 2 also includes various sensors. Specifically, the outdoor unit 2 includes a discharged-refrigerant sensor 42 that detects the pressure of the refrigerant on the discharge side of the compressor 21.

—Refrigerant Connection Pipes—

The refrigerant connection pipes 4 and 5 are refrigerant pipes constructed on site when the air conditioner 1 is installed at an installation site in a building or other place. The refrigerant connection pipes 4 and 5 constitute part of the refrigerant circuit 10.

—Control Unit—

The control unit 19 is composed of control boards and other components (not shown) disposed in the outdoor unit 2 and the indoor unit 3 and connected in communication with each other. In FIG. 1, the control unit 19 is shown as being located apart from the outdoor unit 2 and the indoor unit 3 for illustration purposes. The control unit 19 controls the devices 21, 24, 25, 31, and 32 that constitute the air conditioner 1 (here, the outdoor unit 2 and the indoor unit 3), that is, controls the operation of the overall air conditioner 1.

—Refrigerant Sealed in Refrigerant Circuit—

In the refrigerant circuit 10, a refrigerant containing a hydrofluorocarbon having a property of undergoing a disproportionation reaction is sealed. Examples of such refrigerants include ethylenic hydrofluorocarbons (hydrofluoroolefins), which have less effect on both the ozone layer and global warming and which has carbon-carbon double bonds that are readily decomposed by OH radicals. Here, among hydrofluoroolefins (HFOs), a refrigerant containing HFO-1123 is used. HFO-1123 has properties, such as boiling point, close to those of HFC-32 and HFC-410A and provides high performance. Thus, a refrigerant containing HFO-1123 can be used as an alternative refrigerant to HFC-32 or HFC-410A.

For example, the refrigerant containing HFO-1123 includes HFO-1123 alone or a mixture of HFO-1123 with other refrigerants. An example of the mixture of HFO-1123 with other refrigerants is a mixture of HFO-1123 with HFC-32. Here, HFO-1123 and HFC-32 are mixed in a ratio (wt %) of 40:60. Another example is a mixture of HFO-1123 with HFC-32 and HFO-1234yf (2,3,3,3-tetrafluoropropene). Here, HFO-1123, HFC-32, and HFO-1234yf are mixed in a ratio (wt %) of 40:44:16.

HFC-32, which is a type of HFC, is mixed in such refrigerants containing HFO-1123 as a constituent for improving performance. HFCs having 5 or less carbon atoms are preferred to minimize the effect on the ozone layer and global warming. Specific examples other than HFC-32 include difluoroethane, trifluoroethane, tetrafluoroethane, HFC-125, pentafluoropropane, hexafluoropropane, heptafluoropropane, pentafluorobutane, and heptafluorobutane. Of these, those that have less effect on both the ozone layer and global warming include HFC-32, 1,1-difluoroethane (HFC-152a), 1,1,2,2-tetrafluoroethane (HFC-134), and 1,1,1,2-tetrafluoroethane (HFC-134a). HFO-1123 may be mixed with one or more of these HFCs. HFO-1123 may also be mixed with a hydrochlorofluoroolefins (HCFO), which are less combustible because of their higher proportion of halogen in the molecule. Specific examples include 1-chloro-2,3,3,3-tetrafluoropropene (HCFO-1224yd), 1-chloro-2,2-difluoroethylene (HCFO-1122), 1,2-dichlorofluoroethylene (HCFO-1121), 1-chloro-2-fluoroethylene (HCFO-1131), 2-chloro-3,3,3-trifluoropropene (HCFO-1233xf), and 1-chloro-3,3,3-trifluoropropene (HCFO-1233zd). Of these, those that provide high performance include HCFO-1224yd, and those that have high critical temperature, durability, and coefficient of performance include HCFO-1233zd. HFO-1123 may be mixed with one or more of these HCFOs and HCFCs. HFO-1123 may also be mixed with other refrigerants such as other hydrocarbons and CFOs.

The hydrofluorocarbon having the property of undergoing a disproportionation reaction is not limited to HFO-1123, but may be another HFO. For example, an ethylenic hydrofluorocarbon having the property of undergoing a disproportionation reaction may be selected from 3,3,3-trifluoropropene (HFO-1243zf), 1,3,3,3-tetrafluoropropene (HFO-1234ze), 2-fluoropropene (HFO-1261yf), HFO-1234yf, 1,1,2-trifluoropropene (HFO-1243yc), 1,2,3,3,3-pentafluoropropene (HFO-1225ye), trans-1,3,3,3-tetrafluoropropene (HFO-1234ze(E)), and cis-1,3,3,3-tetrafluoropropene (HFO-1234ze(Z)). The hydrofluorocarbon having the property of undergoing a disproportionation reaction need not be an ethylenic hydrofluorocarbon, which has a carbon-carbon double bond, but may be an acetylenic hydrofluorocarbon, which has a carbon-carbon triple bond, having the property of undergoing a disproportionation reaction.

<Basic Operation>

The air conditioner 1 performs cooling operation as the basic operation. Cooling operation is executed by the control unit 19.

During cooling operation, in the refrigerant circuit 10, gas refrigerant at the low pressure of the refrigeration cycle is taken into the compressor 21, where the gas refrigerant is compressed to the high pressure of the refrigeration cycle before and is then discharged therefrom. The high-pressure gas refrigerant discharged from the compressor 21 enters the outdoor heat exchanger 23. The high-pressure gas refrigerant entering the outdoor heat exchanger 23 releases heat in the outdoor heat exchanger 23 by heat exchange with outdoor air supplied as a cooling source by the outdoor fan 25, thus becoming high-pressure liquid refrigerant. The high-pressure liquid refrigerant that has released heat in the outdoor heat exchanger 23 is sent to the expansion valve 24. The high-pressure liquid refrigerant sent to the expansion valve 24 is decompressed by the expansion valve 24 to the low pressure of the refrigeration cycle, thus becoming low-pressure gas-liquid two-phase refrigerant. The low-pressure gas-liquid two-phase refrigerant decompressed by the expansion valve 24 passes through the liquid-refrigerant connection pipe 4 and enters the indoor heat exchanger 31. The low-pressure gas-liquid two-phase refrigerant entering the indoor heat exchanger 31 evaporates in the indoor heat exchanger 31 by heat exchange with indoor air supplied as a heating source by the indoor fan 32. In this way, the indoor air is cooled. The indoor air is then supplied to the indoor space to cool the indoor space. The low-pressure gas refrigerant evaporated in the indoor heat exchanger 31 passes through the gas-refrigerant connection pipe 5 and is taken into the compressor 21 again.

<Measure Against Disproportionation Reaction of Refrigerant (Configuration for Shutting Off Flow of Refrigerant to Indoor Side)>

Figure 2:
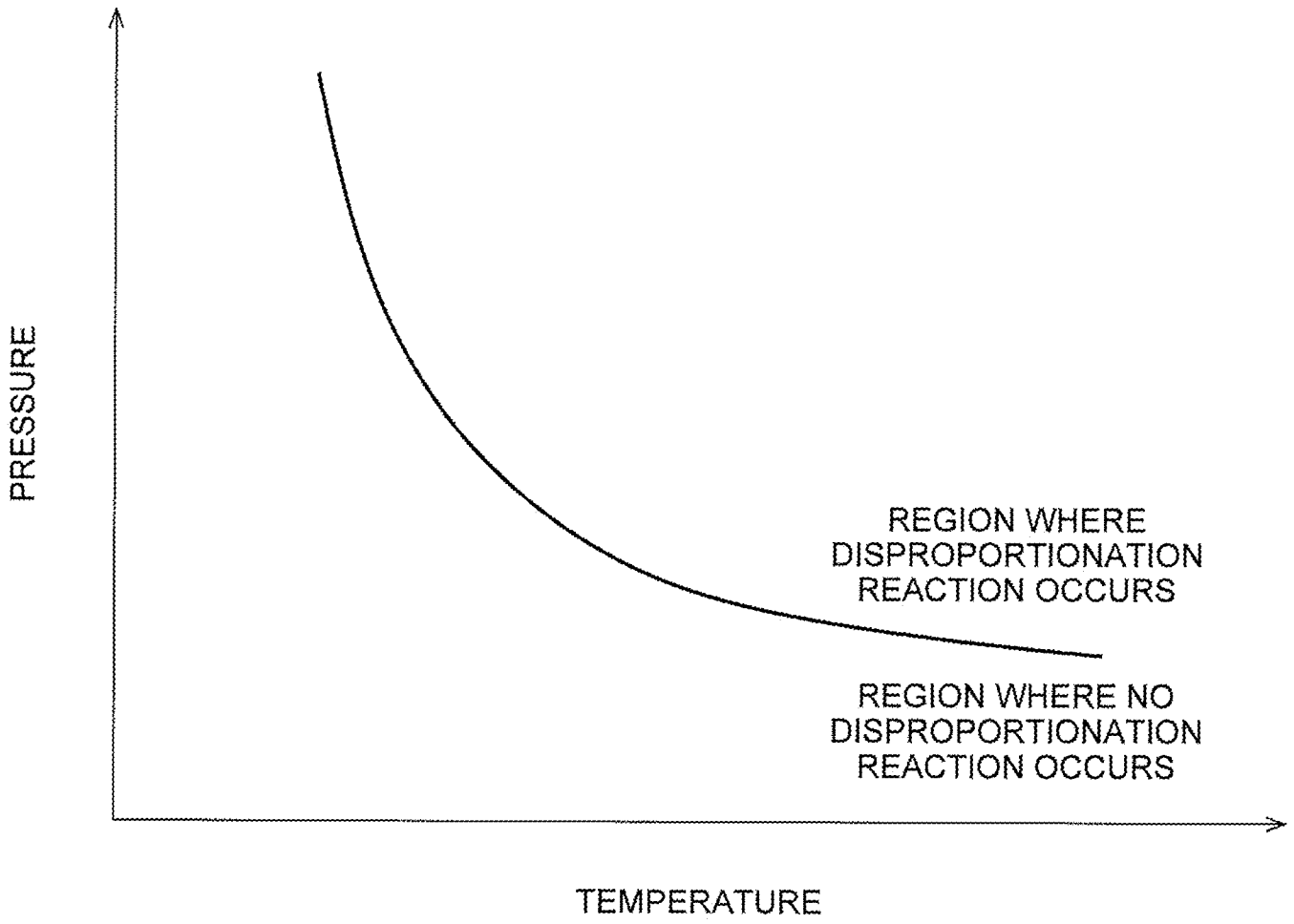
FIG. 2 is a graph showing the relationship between the pressure and temperature at which a refrigerant undergoes a disproportionation reaction.

Refrigerants containing a hydrofluorocarbon having the property of undergoing a disproportionation reaction as described above may undergo a disproportionation reaction when given some energy under high-pressure and high-temperature condition. FIG. 2 is a graph showing the relationship between the pressure and temperature at which a refrigerant undergoes a disproportionation reaction. The curve in FIG. 2 shows the pressure and temperature limit at which the refrigerant undergoes a disproportionation reaction, indicating that the refrigerant undergoes a disproportionation reaction on the curve and in the region above the curve and does not undergo a disproportionation reaction in the region below the curve. When the pressure and temperature of the refrigerant in the refrigerant circuit 10 rise to the curve or the region above the curve where the refrigerant undergoes a disproportionation reaction in FIG. 2, the refrigerant in the refrigerant circuit 10 undergoes a disproportionation reaction that results in a rapid pressure and temperature rise. Here, in the air conditioner 1 composed of the outdoor unit 2 and the indoor unit 3 that are connected together, a disproportionation reaction tends to occur in a portion of the refrigerant circuit 10 within the outdoor unit 2, which includes the compressor 21. If such a disproportionation reaction occurs in a chain reaction manner, the disproportionation reaction and the resulting pressure rise may propagate from the outdoor unit 2 side to the indoor unit 3 side. This may damage the devices and pipes that constitute a portion of the refrigerant circuit 10 within the indoor unit 3 and may thus cause the refrigerant to be ejected into the indoor space.

Accordingly, here, refrigerant shutoff mechanisms are provided, as described below. The refrigerant shutoff mechanisms shut off the flow of the refrigerant from the outdoor unit 2 side to the indoor unit 3 side when the refrigerant in the portion of the refrigerant circuit 10 within the outdoor unit 2 meets a predetermined condition.

—Configuration and Operation—

The portion of the refrigerant circuit 10 within the outdoor unit 2 includes a check valve 41 and an expansion valve 24 as refrigerant shutoff mechanisms.

The check valve 41 is a gas-side refrigerant shutoff mechanism that shuts off the flow of the refrigerant from the intake side of the compressor 21 to the indoor unit 3 side. The check valve 41 is a valve mechanism that allows the refrigerant flow from the gas-refrigerant connection pipe 5 to the intake side of the compressor 21 while shutting off the flow of the refrigerant from the intake side of the compressor 21 to the gas-refrigerant connection pipe 5 side. Here, the check valve 41 is disposed in the intake pipe 11.

The expansion valve 24 is a liquid-side refrigerant shutoff mechanism that shuts off the flow of the refrigerant from the liquid side of the outdoor heat exchanger 23 to the indoor unit 3 side. The expansion valve 24, as described above, is an electric valve that decompresses the refrigerant. Thus, the expansion valve 24 functions both as an expansion mechanism that decompresses the refrigerant flowing between the outdoor heat exchanger 23 and the indoor heat exchanger 31 and as a liquid-side refrigerant shutoff mechanism that shuts off the flow of the refrigerant from the liquid side of the outdoor heat exchanger 23 to the indoor unit 3 side.

Here, during the basic operation (here, cooling operation), when the refrigerant in the portion of the refrigerant circuit 10 within the outdoor unit 2 meets a predetermined condition (when the refrigerant meets a condition for a disproportionation reaction to occur), the check valve 41, serving as the gas-side refrigerant shutoff mechanism, operates to shut off the flow of the refrigerant from the intake side of the compressor 21 to the gas-refrigerant connection pipe 5 side, thereby shutting off the flow of the refrigerant from the intake side of the compressor 21 to the indoor unit 3 side. Also, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side.

Figure 3:
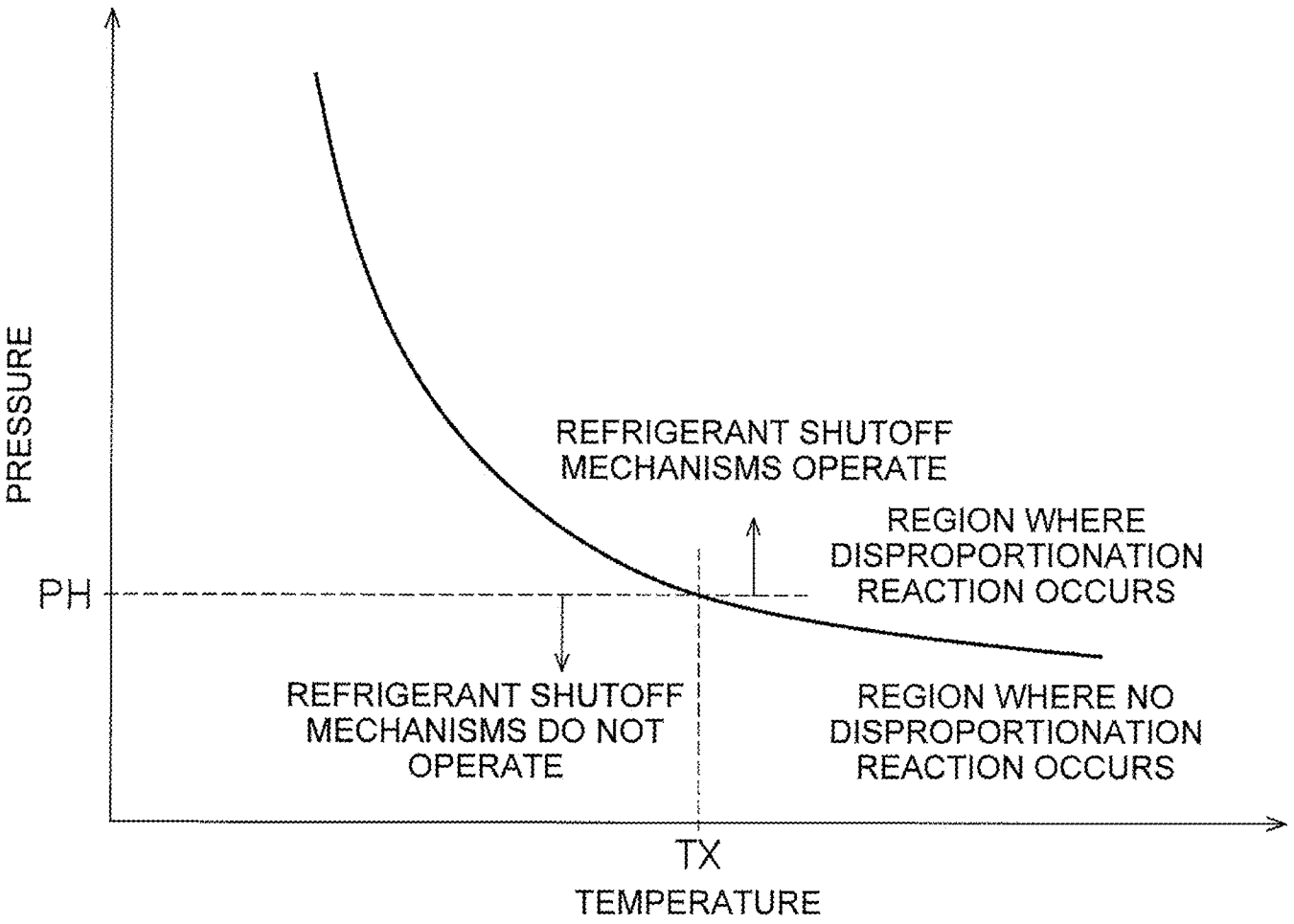
FIG. 3 is a graph showing a predetermined condition (threshold pressure) at which a disproportionation reaction occurs.

Here, the predetermined condition for the refrigerant in the portion of the refrigerant circuit 10 within the outdoor unit 2 (the condition for the refrigerant to undergo a disproportionation reaction) may be a threshold pressure PH corresponding to the lower pressure limit at which the refrigerant on the discharge side of the compressor 21, which tends to reach the highest pressure and temperature, undergoes a disproportionation reaction. For example, as shown in FIG. 3, the threshold pressure PH may be the lower pressure limit (i.e., the value on the curve indicating the pressure and temperature limit at which the refrigerant undergoes a disproportionation reaction) at which the refrigerant undergoes a disproportionation reaction at the maximum operating temperature TX of the refrigerant circuit 10. If this pressure value is close to the maximum operating pressure PX of the refrigerant circuit 10, the threshold pressure PH may be the maximum operating pressure PX. The maximum operating temperature TX and the maximum operating pressure PX of the refrigerant circuit 10 are the upper operating pressure and temperature limits prescribed in view of the design strength of the refrigerant circuit 10 (i.e., the devices and pipes that constitute the refrigerant circuit 10).

Until the pressure of the refrigerant on the discharge side of the compressor 21 (here, the pressure of the refrigerant detected by the discharged-refrigerant sensor 42) reaches the threshold pressure PH, the refrigerant flows from the gas-refrigerant connection pipe 5 toward the intake side of the compressor 21 through the check valve 41, and the refrigerant flows from the liquid side of the outdoor heat exchanger 23 toward the liquid-refrigerant connection pipe 4 through the expansion valve 24, which is in an open state (see the region where the refrigerant shutoff mechanisms do not operate in FIG. 3). That is, until the pressure of the refrigerant on the discharge side of the compressor 21 reaches the threshold pressure PH, the refrigerant in the portion of the refrigerant circuit 10 within the outdoor unit 2 does not meet the predetermined condition (does not meet the condition for a disproportionation reaction to occur). Thus, the basic operation continues without shutting off the flow of the refrigerant from the outdoor unit 2 side to the indoor unit 3 side.

However, when the pressure of the refrigerant on the discharge side of the compressor 21 reaches the threshold pressure PH, the refrigerant on the discharge side of the compressor 21 undergoes a disproportionation reaction. The disproportionation reaction and the resulting pressure rise propagate from the discharge side of the compressor 21 toward other parts of the refrigerant circuit 10. Consequently, the disproportionation reaction of the refrigerant and the resulting pressure rise propagate through the compressor 21 to the intake side of the compressor 21. Thus, the check valve 41, serving as the gas-side refrigerant shutoff mechanism, operates to shut off the flow of the refrigerant from the intake side of the compressor 21 to the gas-refrigerant connection pipe 5 side, thereby shutting off the flow of the refrigerant from the intake side of the compressor 21 to the indoor unit 3 side (see the region where the refrigerant shutoff mechanisms operate in FIG. 3). The disproportionation reaction of the refrigerant and the resulting pressure rise also propagate through the outdoor heat exchanger 23 to the liquid side of the outdoor heat exchanger 23. Thus, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side (see the region where the refrigerant shutoff mechanisms operate in FIG. 3). Here, the expansion valve 24 is operated by the control unit 19. That is, when the pressure of the refrigerant on the discharge side of the compressor 21 reaches the threshold pressure PH, the control unit 19 controls the expansion valve 24 so that it switches from an open state to a fully closed state. The control unit 19 also stops the compressor 21. That is, when the pressure of the refrigerant on the discharge side of the compressor 21 reaches the threshold pressure PH, the refrigerant in the portion of the refrigerant circuit 10 within the outdoor unit 2 meets the predetermined condition (meets the condition for a disproportionation reaction to occur). Thus, the refrigerant shutoff mechanisms 41 and 24 operate to shut off the flow of the refrigerant from the outdoor unit 2 side to the indoor unit 3 side, and the basic operation is stopped.

—Features—

Here, as described above, the refrigerant shutoff mechanisms 41 and 24 are provided in the air conditioner 1 in which the refrigerant circuit 10 is composed of the outdoor unit 2 and the indoor unit 3 that are connected together and a refrigerant containing a hydrofluorocarbon having the property of undergoing a disproportionation reaction is sealed in the refrigerant circuit 10. The refrigerant shutoff mechanisms 41 and 24 shut off the flow of the refrigerant from the outdoor unit 2 side to the indoor unit 3 side when the refrigerant in the portion of the refrigerant circuit 10 within the outdoor unit 2 meets the predetermined condition (when the refrigerant meets the condition for a disproportionation reaction to occur). In particular, here, the refrigerant circuit 10 is configured to circulate the refrigerant through, in sequence, the compressor 21, the outdoor heat exchanger 23, the indoor heat exchanger 31, and the compressor 21 (cooling operation). Therefore, when a disproportionation reaction occurs in the portion of the refrigerant circuit 10 within the outdoor unit 2, it is necessary to shut off the flow of the refrigerant from the intake side of the compressor 21 to the indoor unit 3 side and the flow of the refrigerant from the liquid side of the outdoor heat exchanger 23 to the indoor unit 3 side. Accordingly, here, the gas-side refrigerant shutoff mechanism 41 and the liquid-side refrigerant shutoff mechanism 24 as described above are provided as refrigerant shutoff mechanisms in the refrigerant circuit 10.

Thus, here, when a disproportionation reaction occurs in the portion of the refrigerant circuit 10 within the outdoor unit 2, the refrigerant shutoff mechanisms 41 and 24 can shut off the flow of the refrigerant from the outdoor unit 2 side to the indoor unit 3 side, thereby inhibiting the propagation of the disproportionation reaction and the resulting pressure rise to the indoor unit 3.

Thus, here, even when the refrigerant undergoes a disproportionation reaction, a likelihood that the devices and pipes that constitute the portion of the refrigerant circuit 10 within the unit 3 is damaged can be reduced, thereby reducing the likelihood of the refrigerant being ejected into the indoor space. In particular, here, when a disproportionation reaction occurs in the portion of the refrigerant circuit 10 within the outdoor unit 2 while the refrigerant is being circulated in the refrigerant circuit 10 through, in sequence, the compressor 21, the outdoor heat exchanger 23, the indoor heat exchanger 31, and the compressor 21, the gas-side refrigerant shutoff mechanism 41 and the liquid-side refrigerant shutoff mechanism 24 can shut off the flow of the refrigerant from the outdoor unit 2 side to the indoor unit 3 side.

It is also possible to provide the refrigerant shutoff mechanisms in the refrigerant connection pipes 4 and 5, rather than in the outdoor unit 2. However, since portions of the refrigerant connection pipes 4 and 5 are disposed inside a building, it is undesirable to provide the refrigerant shutoff mechanisms in the refrigerant connection pipes 4 and 5 in view of the possibility of the refrigerant being ejected into the indoor space due to damage to the refrigerant connection pipes 4 and 5. Thus, it is preferred to provide the refrigerant shutoff mechanisms in the outdoor unit 2.

Here, as described above, the gas-side refrigerant shutoff mechanism is the check valve 41. The check valve 41 can therefore shut off the flow of the refrigerant from the intake side of the compressor 21 to the indoor unit 3 side without electrical control.

Here, as described above, the liquid-side refrigerant shutoff mechanism is the expansion valve 24. The expansion valve 24 can be used for decompression while the refrigerant is being circulated in the refrigerant circuit 10. Further, when the refrigerant in the portion of the refrigerant circuit 10 within the outdoor unit 2 meets the predetermined condition (when the refrigerant meets the condition for a disproportionation reaction to occur), the expansion valve 24 can be closed by electrical control to shut off the flow of the refrigerant from the liquid side of the outdoor heat exchanger 23 to the indoor unit 3 side.

If a refrigerant containing HFO-1123 is used as the refrigerant containing a hydrofluorocarbon having the property of undergoing a disproportionation reaction, it can be used as an alternative refrigerant to HFC-32 or HFC-410A. Even when the refrigerant undergoes a disproportionation reaction, it can be inhibited that the portion of the refrigerant circuit 10 within the indoor unit 3 is damaged, thereby reducing the likelihood of the refrigerant being ejected into the indoor space.

<First Modification>

Figure 4:
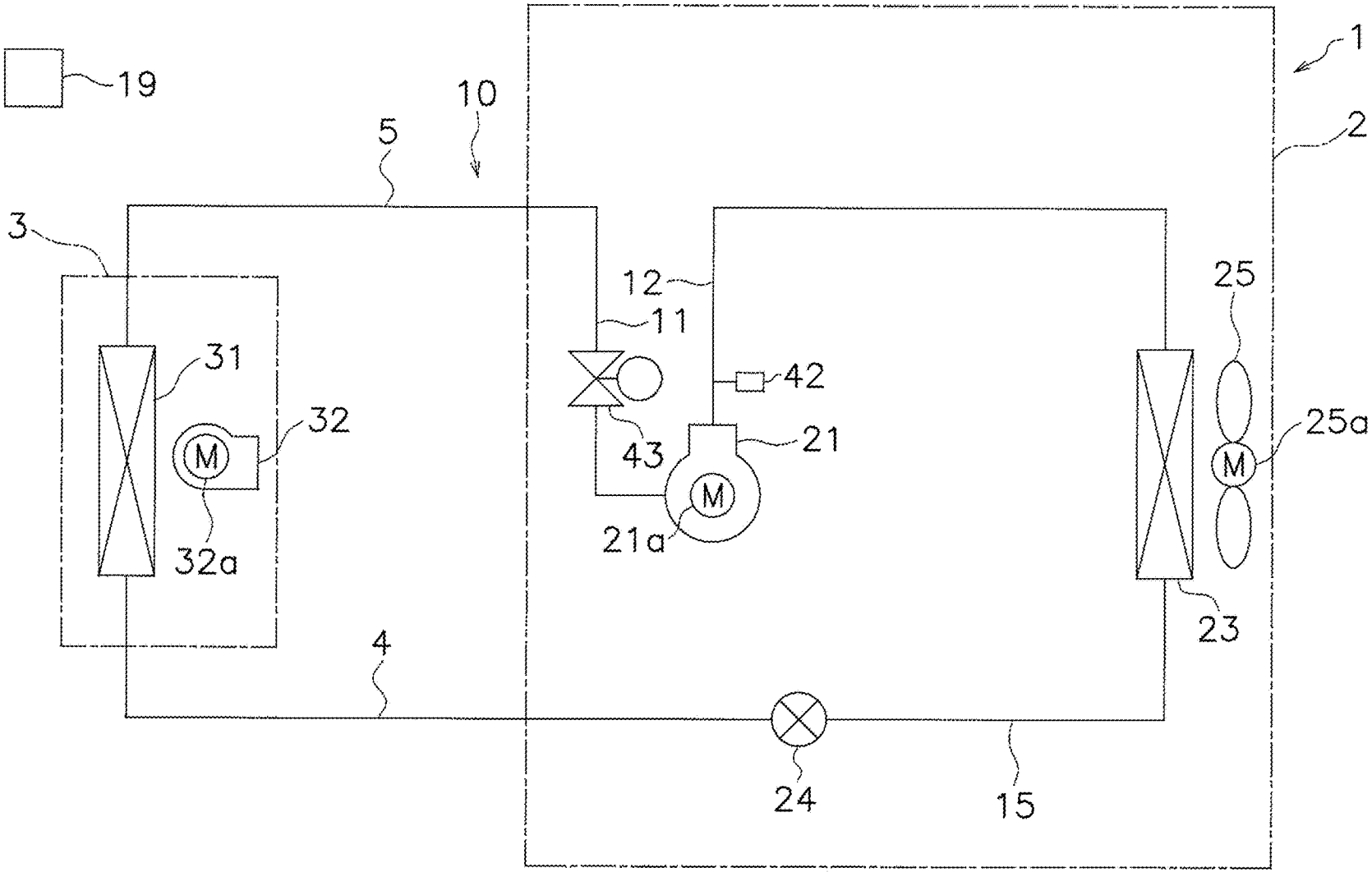
FIG. 4 is a schematic diagram of an air conditioner according to a first modification of the first embodiment.

Although, in the first embodiment, the check valve 41 is used as the gas-side refrigerant shutoff mechanism, the gas-side refrigerant shutoff mechanism is not limited thereto; rather, as shown in FIG. 4, an electromagnetic valve 43 may be used as a gas-side refrigerant shutoff mechanism.

The electromagnetic valve 43 is a valve mechanism whose opening and closing state is electrically controlled by the control unit 19. Here, the electromagnetic valve 43 is disposed in the intake pipe 11.

The electromagnetic valve 43 is controlled so that it is in an open state during the basic operation. When the refrigerant in the portion of the refrigerant circuit 10 within the outdoor unit 2 meets the predetermined condition (e.g., when the pressure of the refrigerant on the discharge side of the compressor 21 reaches the threshold pressure PH), the electromagnetic valve 43 is controlled so that it switches to a closed state.

Thus, here, when the refrigerant in the portion of the refrigerant circuit 10 within the outdoor unit 2 meets the condition for a disproportionation reaction to occur, the electromagnetic valve 43, serving as the gas-side refrigerant shutoff mechanism, operates to shut off the flow of the refrigerant from the intake side of the compressor 21 to the gas-refrigerant connection pipe 5 side, thereby shutting off the flow of the refrigerant from the intake side of the compressor 21 to the indoor unit 2.

In this configuration, as in the first embodiment, when the refrigerant in the portion of the refrigerant circuit 10 within the outdoor unit 2 meets the predetermined condition (when the refrigerant meets the condition for a disproportionation reaction to occur), the refrigerant shutoff mechanisms 43 and 24 can shut off the flow of the refrigerant from the outdoor unit 2 side to the indoor unit 3 side, thereby inhibiting the propagation of the disproportionation reaction and the resulting pressure rise to the indoor unit 3.

<Second Modification>

In the first embodiment and the first modification, the refrigerant shutoff mechanisms are used as a measure against the disproportionation reaction of the refrigerant. It is preferred to use, in addition to the refrigerant shutoff mechanisms, another measure against the disproportionation reaction of the refrigerant.

Figure 5:
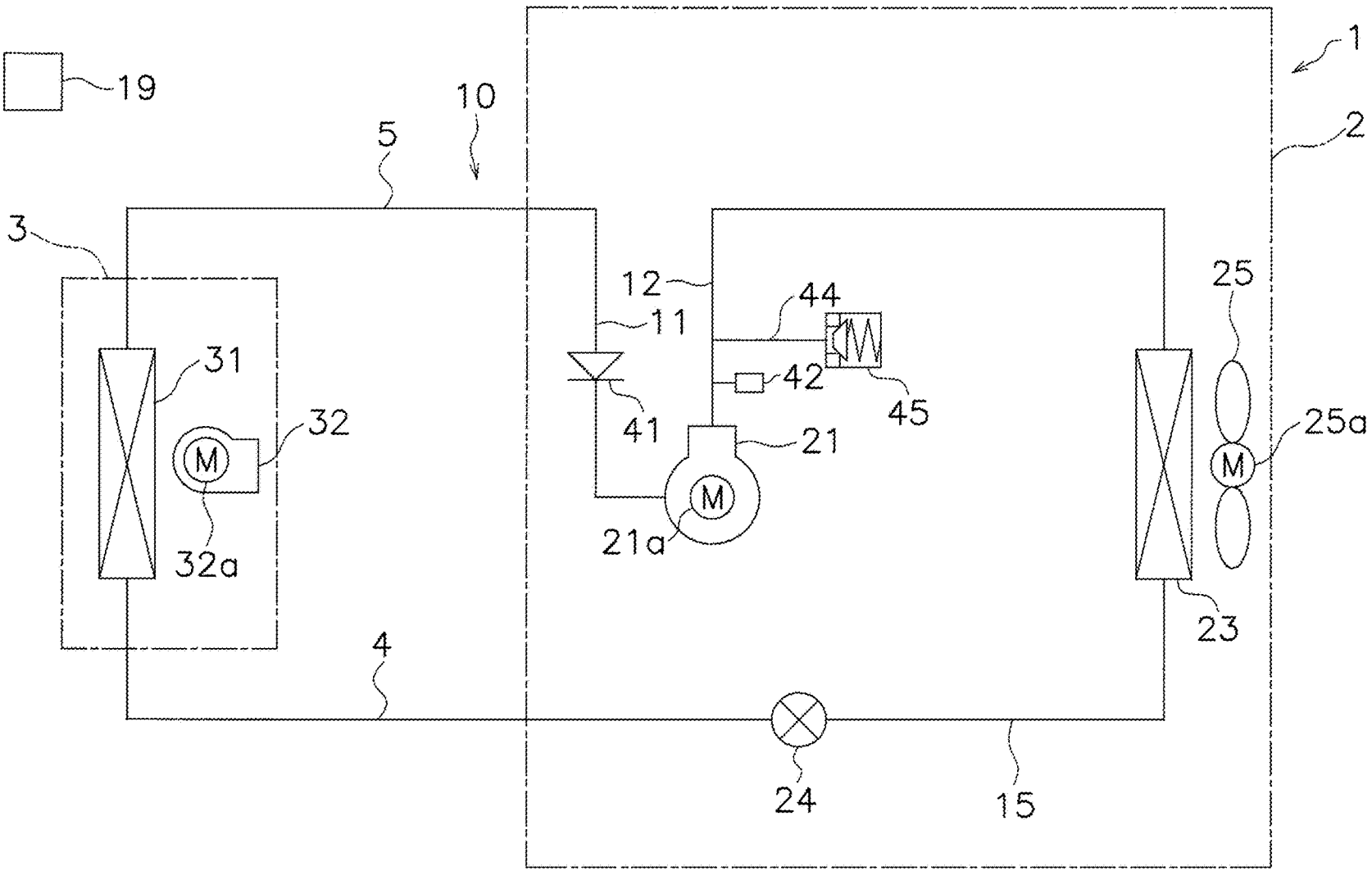
FIG. 5 is a schematic diagram of an air conditioner according to a second modification of the first embodiment.

Accordingly, here, as shown in FIG. 5, a relief valve 45 is further provided as a refrigerant relief mechanism. The relief valve 45 releases the refrigerant out of the refrigerant circuit 10 when the refrigerant in the portion of the refrigerant circuit 10 within the outdoor unit 2 meets the predetermined condition (e.g., when the pressure of the refrigerant on the discharge side of the compressor 21 reaches the threshold pressure PH).

The relief valve 45 is connected between the discharge side of the compressor 21 and the gas side of the outdoor heat exchanger 23 (here, in the discharge pipe 12) in a branched manner via a discharge branch pipe 44. The relief valve 45 releases the refrigerant out of the refrigerant circuit 10 from the discharge side of the compressor 21 when the refrigerant in the portion of the refrigerant circuit 10 within the outdoor unit 2 meets the predetermined condition (when the refrigerant meets the condition for a disproportionation reaction to occur). Here, the relief valve 45 is a valve mechanism that operates when the pressure on the primary side (here, on the discharge side of the compressor 21) reaches a prescribed pressure or higher. For example, the relief valve 45 is a mechanical valve mechanism such as a spring-loaded relief valve or a rupture disk. Here, the prescribed pressure for the relief valve 45 is set to the threshold pressure PH, which is a predetermined condition for the refrigerant in the portion of the refrigerant circuit 10 within the outdoor unit 2 (the condition for a disproportionation reaction to occur).

The relief valve 45 does not operate during the basic operation. When the refrigerant in the portion of the refrigerant circuit 10 within the outdoor unit 2 meets the predetermined condition (when the refrigerant meets the condition for a disproportionation reaction to occur), the relief valve 45 operates to release the refrigerant out of the refrigerant circuit 10.

Thus, here, when the refrigerant in the portion of the refrigerant circuit 10 within the outdoor unit 2 meets the predetermined condition (when the refrigerant meets the condition for a disproportionation reaction to occur), the refrigerant shutoff mechanisms 41, 43, and 24 can shut off the flow of the refrigerant from the outdoor unit 2 side to the indoor unit 3 side, and the refrigerant relief mechanism 45 can release the refrigerant out of the refrigerant circuit 10, thereby further inhibiting the propagation of the disproportionation reaction and the resulting pressure rise to the indoor unit 3.

If a mechanical valve mechanism as described above is provided as the refrigerant relief mechanism 45, a limit switch or other device may be provided on the refrigerant relief mechanism 45 so that it sends an operating signal to the control unit 19 when the refrigerant relief mechanism 45 operates. In response to the operating signal from the refrigerant relief mechanism 45, the control unit 19 may operate the refrigerant shutoff mechanisms 43 and 24 to shut off the flow of the refrigerant from the outdoor unit 2 side to the indoor unit 3 side.

Instead of a mechanical valve mechanism, a valve mechanism that is electrically controlled by the control unit 19, such as an electromagnetic valve, may be used as the refrigerant relief mechanism 45. In this case, as with the refrigerant shutoff mechanisms 43 and 24, when the pressure of the refrigerant on the discharge side of the compressor 21 reaches the threshold pressure PH, the control unit 19 can operate the refrigerant relief mechanism 45 so that it switches from a closed state to an open state.

Figure 6:
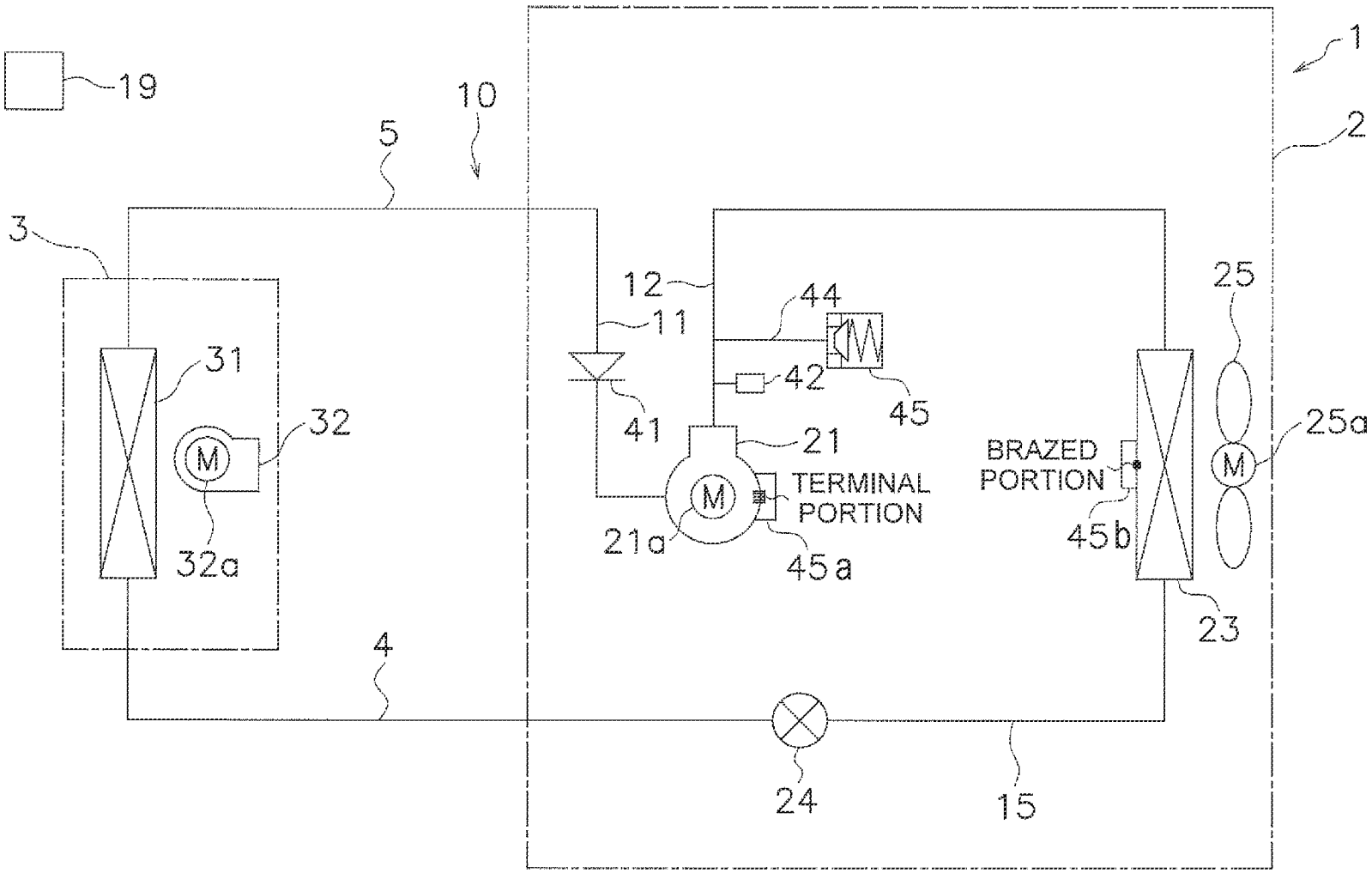
FIG. 6 is a schematic diagram of the air conditioner according to the second modification of the first embodiment.

Configurations different from the relief valve disposed on the discharge side of the compressor 21 may also be used as refrigerant relief mechanisms 45. For example, as shown in FIG. 6, the compressor 21 may have a metal terminal cover 45*a* covering a terminal portion of the compressor 21. In this case, the refrigerant can be released out of the refrigerant circuit 10 through the terminal portion of the compressor 21. In addition, as shown in FIG. 6, the outdoor heat exchanger 23 may have a protective cover covering a brazed portion 45*b* of the outdoor heat exchanger 23. In this case, the refrigerant can be released out of the refrigerant circuit 10 through the brazed portion of the outdoor heat exchanger 23. These refrigerant relief mechanisms 45, 45*a*, 45*b* may be used alone or in combination.

<Third Modification>

Although, in the first embodiment and the first and second modifications, the expansion valve 24, which decompresses the refrigerant flowing between the outdoor heat exchanger 23 and the indoor heat exchanger 31, is used as the liquid-side refrigerant shutoff mechanism, the liquid-side refrigerant shutoff mechanism is not limited thereto; rather, an additional valve mechanism capable of opening and closing, such as an electromagnetic valve, may be provided as the liquid-side refrigerant shutoff mechanism somewhere in the path of the refrigerant circuit 10 from the discharge side of the compressor 21 through the outdoor heat exchanger 23 and the expansion valve 24 to the liquid-refrigerant connection pipe 4. In this case, when the refrigerant in the portion of the refrigerant circuit 10 within the outdoor unit 2 meets the predetermined condition (when the refrigerant meets the condition for a disproportionation reaction to occur), the control unit 19 can control the additional valve mechanism so that it switches from an open state to a closed state, thereby shutting off the flow of the refrigerant from the liquid side of the outdoor heat exchanger 23 to the indoor unit 3 side.

(2) Second Embodiment

Figure 7:
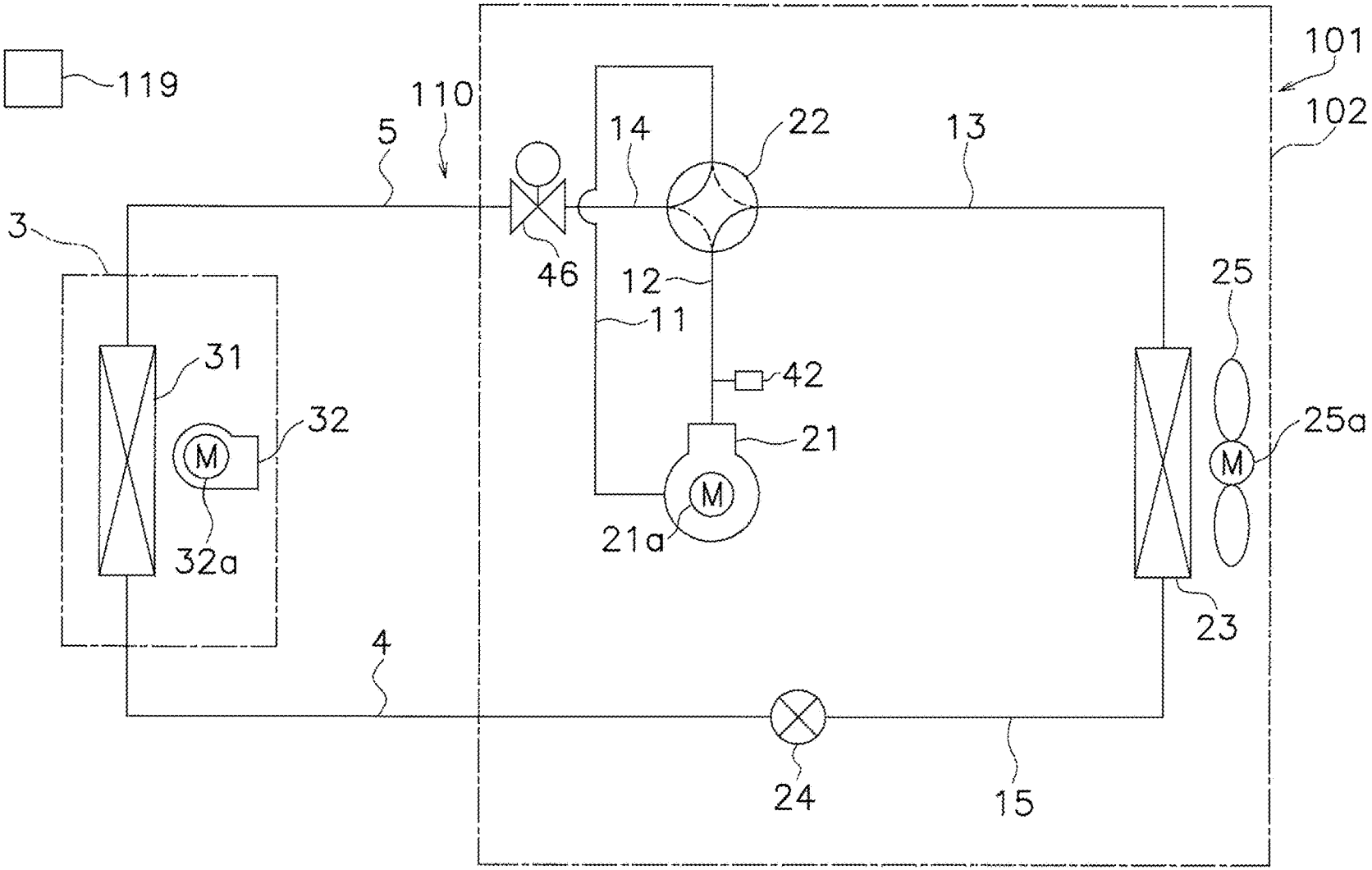
FIG. 7 is a schematic diagram of an air conditioner according to a second embodiment of the present invention.

Although examples in which the present invention is applied to the cooling-only air conditioner 1, which performs cooling operation as the basic operation, are described in the first embodiment and the modifications thereof, the present invention is not limited thereto, but can also be applied to an air conditioner 101 capable of switching between cooling and heating that performs cooling operation and heating operation as the basic operation, as shown in FIG. 7.

<Basic Configuration>

—Overall Apparatus—

The air conditioner 101 is an apparatus capable of cooling and heating the indoor space of a building or other place through a vapor-compression refrigeration cycle. The air conditioner 101 mainly includes an outdoor unit 102, an indoor unit 3, a liquid-refrigerant connection pipe 4 and a gas-refrigerant connection pipe 5 that connect the outdoor unit 102 and the indoor unit 3 together, and a control unit 119 that controls the devices that constitute the outdoor unit 102 and the indoor unit 3. The outdoor unit 102 and the indoor unit 3 are connected together via the refrigerant connection pipes 4 and 5 to constitute a vapor-compression refrigerant circuit 110 of the air conditioner 1.

—Indoor Unit—

The indoor unit 3 is installed indoors and constitutes part of the refrigerant circuit 110. The configuration of the indoor unit 3 is the same as that of the first embodiment and the modifications thereof; therefore, a description thereof is omitted here.

—Outdoor Unit—

The outdoor unit 102 is installed outdoors and constitutes part of the refrigerant circuit 110. The outdoor unit 102 mainly includes a compressor 21, a four-way switching valve 22, an outdoor heat exchanger 23, an expansion valve 24, and an outdoor fan 25.

The compressor 21 is a device for compressing the refrigerant. For example, the compressor 21 is a compressor in which a positive-displacement compression element (not shown) is driven to rotate by a compressor motor 21*a*. An intake pipe 11 is connected to the intake side of the compressor 21, whereas a discharge pipe 12 is connected to the discharge side of the compressor 21. The intake pipe 11 is connected to the four-way switching valve 22.

The outdoor heat exchanger 23 is a heat exchanger that exchanges heat between outdoor air and the refrigerant circulated between the indoor unit 3 and the outdoor unit 102 through the liquid-refrigerant connection pipe 4 and the gas-refrigerant connection pipe 5. The liquid side of the outdoor heat exchanger 23 is connected to a liquid refrigerant pipe 15, whereas the gas side of the outdoor heat exchanger 23 is connected to a first gas refrigerant pipe 13. The liquid refrigerant pipe 15 is connected to the liquid-refrigerant connection pipe 4. The first gas refrigerant pipe 13 is connected to the four-way switching valve 22.

The expansion valve 24 is an electric valve that decompresses the refrigerant and is disposed in the liquid refrigerant pipe 15.

The four-way switching valve 22 is a valve mechanism that switches the circulation direction of the refrigerant in the refrigerant circuit 110. When the refrigerant is circulated through, in sequence, the compressor 21, the outdoor heat exchanger 23, the expansion valve 24, the indoor heat exchanger 31, and the compressor 21 (hereinafter referred to as "heat release state"), the four-way switching valve 22 connects the discharge side of the compressor 21 (here, the discharge pipe 12) and the gas side of the outdoor heat exchanger 23 (here, the first gas refrigerant pipe 13) and connects the intake side of the compressor 21 (here, the intake pipe 11) and the gas-refrigerant connection pipe 5 side (here, a second gas refrigerant pipe 14) (see the solid lines in the four-way switching valve 22 in FIG. 7). Here, the second gas refrigerant pipe 14 is connected to the four-way switching valve 22 and the gas-refrigerant connection pipe 5. When the refrigerant is circulated through, in sequence, the compressor 21, the indoor heat exchanger 31, the expansion valve 24, the outdoor heat exchanger 23, and the compressor 21 (hereinafter referred to as "evaporation state"), the four-way switching valve 22 connects the discharge side of the compressor 21 (here, the discharge pipe 12) and the gas-refrigerant connection pipe 5 side (here, the second gas refrigerant pipe 14) and connects the intake side of the compressor 21 (here, the intake pipe 11) and the gas side of the outdoor heat exchanger 23 (here, the first gas refrigerant pipe 13) (see the dashed lines in the four-way switching valve 22 in FIG. 7).

The outdoor fan 25 is a fan that blows outdoor air to the outdoor heat exchanger 23. The outdoor fan 25 is driven by an outdoor fan motor 25*a*.

The outdoor unit 102 also includes various sensors. Specifically, the outdoor unit 102 includes a discharged-refrigerant sensor 42 that detects the pressure of the refrigerant on the discharge side of the compressor 21.

—Refrigerant Connection Pipes—

The refrigerant connection pipes 4 and 5 are refrigerant pipes constructed on site when the air conditioner 101 is installed at an installation site in a building or other place. The refrigerant connection pipes 4 and 5 constitute part of the refrigerant circuit 110.

—Control Unit—

The control unit 119 is composed of control boards and other components (not shown) disposed in the outdoor unit 102 and the indoor unit 3 and connected in communication with each other. In FIG. 7, the control unit 119 is shown as being located apart from the outdoor unit 102 and the indoor unit 3 for illustration purposes. The control unit 119 controls the devices 21, 22, 24, 25, 31, and 32 that constitute the air conditioner 101 (here, the outdoor unit 102 and the indoor unit 3), that is, controls the operation of the overall air conditioner 1.

—Refrigerant Sealed in Refrigerant Circuit—

In the refrigerant circuit 110, a refrigerant containing a hydrofluorocarbon having a property of undergoing a disproportionation reaction is sealed. The refrigerant sealed in the refrigerant circuit 110 is the same as that of the first embodiment and the modifications thereof; therefore, a description thereof is omitted here.

<Basic Operation>

The air conditioner 101 performs cooling operation and heating operation as the basic operation. Cooling operation and cooling operation are executed by the control unit 119.

—Cooling Operation—

During cooling operation, the four-way switching valve 22 is switched to the heat release state (the state indicated by the solid lines in FIG. 7). In the refrigerant circuit 110, gas refrigerant at the low pressure of the refrigeration cycle is taken into the compressor 21, where the gas refrigerant is compressed to the high pressure of the refrigeration cycle and is then discharged therefrom. The high-pressure gas refrigerant discharged from the compressor 21 passes through the four-way switching valve 22 and enters the outdoor heat exchanger 23. The high-pressure gas refrigerant entering the outdoor heat exchanger 23 releases heat in the outdoor heat exchanger 23 by heat exchange with outdoor air supplied as a cooling source by the outdoor fan 25, thus becoming high-pressure liquid refrigerant. The high-pressure liquid refrigerant that has released heat in the outdoor heat exchanger 23 is sent to the expansion valve 24. The high-pressure liquid refrigerant sent to the expansion valve 24 is decompressed by the expansion valve 24 to the low pressure of the refrigeration cycle, thus becoming low-pressure gas-liquid two-phase refrigerant. The low-pressure gas-liquid two-phase refrigerant decompressed by the expansion valve 24 passes through the liquid-refrigerant connection pipe 4 and enters the indoor heat exchanger 31. The low-pressure gas-liquid two-phase refrigerant entering the indoor heat exchanger 31 evaporates in the indoor heat exchanger 31 by heat exchange with indoor air supplied as a heating source by the indoor fan 32. In this way, the indoor air is cooled. The indoor air is then supplied to the indoor space to cool the indoor space. The low-pressure gas refrigerant evaporated in the indoor heat exchanger 31 passes through the gas-refrigerant connection pipe 5 and the four-way switching valve 22 and is taken into the compressor 21 again.

—Heating Operation—

During heating operation, the four-way switching valve 22 is switched to the evaporation state (the state indicated by the dashed lines in FIG. 7). In the refrigerant circuit 110, gas refrigerant at the low pressure of the refrigeration cycle is taken into the compressor 21, where the gas refrigerant is compressed to the high pressure of the refrigeration cycle and is then discharged therefrom. The high-pressure gas refrigerant discharged from the compressor 21 passes through the four-way switching valve 22 and the gas-refrigerant connection pipe 5 and enters the indoor heat exchanger 31. The high-pressure gas refrigerant entering the indoor heat exchanger 31 releases heat in the indoor heat exchanger 31 by heat exchange with indoor air supplied as a cooling source by the indoor fan 32, thus becoming high-pressure liquid refrigerant. In this way, the indoor air is heated. The indoor air is then supplied to the indoor space to heat the indoor space. The high-pressure liquid refrigerant that has released heat in the indoor heat exchanger 31 passes through the liquid-refrigerant connection pipe 4 and is sent to the expansion valve 24. The high-pressure liquid refrigerant sent to the expansion valve 24 is decompressed by the expansion valve 24 to the low pressure of the refrigeration cycle, thus becoming low-pressure gas-liquid two-phase refrigerant. The low-pressure gas-liquid two-phase refrigerant decompressed by the expansion valve 24 enters the outdoor heat exchanger 23. The low-pressure gas-liquid two-phase refrigerant entering the outdoor heat exchanger 23 evaporates in the outdoor heat exchanger 23 by heat exchange with outdoor air supplied as a heating source by the outdoor fan 25, thus becoming low-pressure gas refrigerant. The low-pressure gas refrigerant evaporated in the outdoor heat exchanger 23 passes through the four-way switching valve 22 and is taken into the compressor 21 again.

<Measure against Disproportionation Reaction of Refrigerant (Configuration for Shutting off Flow of Refrigerant to Indoor Side)>

In the air conditioner 101 according to this embodiment, as in the air conditioner 1 according to the first embodiment and the modifications thereof, a disproportionation reaction tends to occur in a portion of the refrigerant circuit 110 within the outdoor unit 102, which includes the compressor 21. If such a disproportionation reaction occurs in a chain reaction manner, the disproportionation reaction and the resulting pressure rise may propagate from the outdoor unit 102 side to the indoor unit 3 side. This may damage the devices and pipes that constitute a portion of the refrigerant circuit 110 within the indoor unit 3 and may thus cause the refrigerant to be ejected into the indoor space.

Accordingly, in this embodiment, refrigerant shutoff mechanisms are provided, as described below. The refrigerant shutoff mechanisms shut off the flow of the refrigerant from the outdoor unit 102 side to the indoor unit 3 side when the refrigerant in the portion of the refrigerant circuit 110 within the outdoor unit 102 meets a predetermined condition.

—Configuration and Operation—

The portion of the refrigerant circuit 110 within the outdoor unit 102 includes an electromagnetic valve 46 and an expansion valve 24 as refrigerant shutoff mechanisms.

The electromagnetic valve 46 is a gas-side refrigerant shutoff mechanism that shuts off the flow of the refrigerant from the intake side of the compressor 21 to the indoor unit 3 side during cooling operation being performed as the basic operation. The electromagnetic valve 46 is also a gas-side refrigerant shutoff mechanism that shuts off the flow of the refrigerant from the discharge side of the compressor 21 to the indoor unit 3 side during heating operation being performed as the basic operation. The electromagnetic valve 46 is a valve mechanism whose opening and closing state is electrically controlled by the control unit 119. Here, the electromagnetic valve 46 is disposed in a second gas refrigerant pipe 14 connecting the four-way switching valve 22 and the gas-refrigerant connection pipe 5.

The expansion valve 24 is a liquid-side refrigerant shutoff mechanism that shuts off the flow of the refrigerant from the liquid side of the outdoor heat exchanger 23 to the indoor unit 3 side. The expansion valve 24, as described above, is an electric valve that decompresses the refrigerant. Thus, the expansion valve 24 functions both as an expansion mechanism that decompresses the refrigerant flowing between the outdoor heat exchanger 23 and the indoor heat exchanger 31 and as a liquid-side refrigerant shutoff mechanism that shuts off the flow of the refrigerant from the liquid side of the outdoor heat exchanger 23 to the indoor unit 3 side.

Here, during cooling operation being performed as the basic operation, when the refrigerant in the portion of the refrigerant circuit 110 within the outdoor unit 102 meets a predetermined condition (when the refrigerant meets a condition for a disproportionation reaction to occur), the electromagnetic valve 46, serving as the gas-side refrigerant shutoff mechanism, operates to shut off the flow of the refrigerant from the intake side of the compressor 21 to the gas-refrigerant connection pipe 5 side, thereby shutting off the flow of the refrigerant from the intake side of the compressor 21 to the indoor unit 3 side. Also, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side. During heating operation being performed as the basic operation, when the refrigerant in the portion of the refrigerant circuit 110 within the outdoor unit 102 meets the predetermined condition (when the refrigerant meets the condition for a disproportionation reaction to occur), the electromagnetic valve 46, serving as the gas-side refrigerant shutoff mechanism, operates to shut off the flow of the refrigerant from the discharge side of the compressor 21 to the gas-refrigerant connection pipe 5 side, thereby shutting off the flow of the refrigerant from the discharge side of the compressor 21 to the indoor unit 3 side. Also, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side.

Here, the predetermined condition for the refrigerant in the portion of the refrigerant circuit 110 within the outdoor unit 2 (the condition for the refrigerant to undergo a disproportionation reaction) may be a threshold pressure PH corresponding to the lower pressure limit at which the refrigerant on the discharge side of the compressor 21, which tends to reach the highest pressure and temperature, undergoes a disproportionation reaction. The threshold pressure PH is the same as that of the first embodiment and the modifications thereof; therefore, a description thereof is omitted here.

During cooling operation being performed as the basic operation, until the pressure of the refrigerant on the discharge side of the compressor 21 (here, the pressure of the refrigerant detected by the discharged-refrigerant sensor 42) reaches the threshold pressure PH, the refrigerant flows from the gas-refrigerant connection pipe 5 toward the intake side of the compressor 21 through the electromagnetic valve 46, and the refrigerant flows from the liquid side of the outdoor heat exchanger 23 toward the liquid-refrigerant connection pipe 4 through the expansion valve 24, which is in an open state. That is, until the pressure of the refrigerant on the discharge side of the compressor 21 reaches the threshold pressure PH, the refrigerant in the portion of the refrigerant circuit 110 within the outdoor unit 102 does not meet the predetermined condition (does not meet the condition for a disproportionation reaction to occur). Thus, the cooling operation continues without shutting off the flow of the refrigerant from the outdoor unit 102 side to the indoor unit 3 side.

However, when the pressure of the refrigerant on the discharge side of the compressor 21 reaches the threshold pressure PH, the refrigerant on the discharge side of the compressor 21 undergoes a disproportionation reaction. Then, the disproportionation reaction and the resulting pressure rise propagate from the discharge side of the compressor 21 toward other parts of the refrigerant circuit 110. The disproportionation reaction of the refrigerant and the resulting pressure rise propagate through the compressor 21 to the intake side of the compressor 21. Thus, the electromagnetic valve 46, serving as the gas-side refrigerant shutoff mechanism, operates to shut off the flow of the refrigerant from the intake side of the compressor 21 to the gas-refrigerant connection pipe 5 side, thereby shutting off the flow of the refrigerant from the intake side of the compressor 21 to the indoor unit 3 side. The disproportionation reaction of the refrigerant and the resulting pressure rise also propagate through the outdoor heat exchanger 23 to the liquid side of the outdoor heat exchanger 23. Thus, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side. Here, the electromagnetic valve 46 and the expansion valve 24 are operated by the control unit 119. That is, when the pressure of the refrigerant on the discharge side of the compressor 21 reaches the threshold pressure PH, the control unit 119 controls the electromagnetic valve 46 and the expansion valve 24 so that they switch from an open state to a fully closed state. The control unit 119 also stops the compressor 21. That is, when the pressure of the refrigerant on the discharge side of the compressor 21 reaches the threshold pressure PH, the refrigerant in the portion of the refrigerant circuit 110 within the outdoor unit 102 meets the predetermined condition (meets the condition for a disproportionation reaction to occur). Thus, the refrigerant shutoff mechanisms 46 and 24 operate to shut off the flow of the refrigerant from the outdoor unit 102 side to the indoor unit 3 side, and the cooling operation is stopped.

During heating operation being performed as the basic operation, until the pressure of the refrigerant on the discharge side of the compressor 21 (here, the pressure of the refrigerant detected by the discharged-refrigerant sensor 42) reaches the threshold pressure PH, the refrigerant flows from the discharge side of the compressor 21 toward the gas-refrigerant connection pipe 5 side through the electromagnetic valve 46, and the refrigerant flows from the liquid-refrigerant connection pipe 4 toward the liquid side of the outdoor heat exchanger 23 through the expansion valve 24, which is in an open state. That is, until the pressure of the refrigerant on the discharge side of the compressor 21 reaches the threshold pressure PH, the refrigerant in the portion of the refrigerant circuit 110 within the outdoor unit 102 does not meet the predetermined condition (does not meet the condition for a disproportionation reaction to occur). Thus, the heating operation continues without shutting off the flow of the refrigerant from the outdoor unit 102 side to the indoor unit 3 side.

However, when the pressure of the refrigerant on the discharge side of the compressor 21 reaches the threshold pressure PH, the refrigerant on the discharge side of the compressor 21 undergoes a disproportionation reaction. Then, the disproportionation reaction and the resulting pressure rise propagate from the discharge side of the compressor 21 toward other parts of the refrigerant circuit 110. Thus, on the discharge side of the compressor 21, the electromagnetic valve 46, serving as the gas-side refrigerant shutoff mechanism, operates to shut off the flow of the refrigerant from the discharge side of the compressor 21 to the gas-refrigerant connection pipe 5 side, thereby shutting off the flow of the refrigerant from the discharge side of the compressor 21 to the indoor unit 3 side. The disproportionation reaction of the refrigerant and the resulting pressure rise also propagate through the compressor 21 and the outdoor heat exchanger 23 to the liquid side of the outdoor heat exchanger 23. Thus, the expansion valve 24, serving as the liquid-side refrigerant shutoff mechanism, operates to switch from an open state to a fully closed state, thereby shutting off the flow of the refrigerant from the liquid side of the outdoor heat exchanger 23 to the indoor unit 3 side. Here, the electromagnetic valve 46 and the expansion valve 24 are operated by the control unit 119. The control unit 119 also stops the compressor 21. That is, when the pressure of the refrigerant on the discharge side of the compressor 21 reaches the threshold pressure PH, the refrigerant in the portion of the refrigerant circuit 110 within the outdoor unit 102 meets the predetermined condition (meets the condition for a disproportionation reaction to occur). Thus, the refrigerant shutoff mechanisms 46 and 24 operate to shut off the flow of the refrigerant from the outdoor unit 102 side to the indoor unit 3 side, and the heating operation is stopped.

—Features—

Here, as described above, the refrigerant shutoff mechanisms 46 and 24 are provided in the air conditioner 101 in which the refrigerant circuit 110 is composed of the outdoor unit 102 and the indoor unit 3 that are connected together and a refrigerant containing a hydrofluorocarbon having the property of undergoing a disproportionation reaction is sealed in the refrigerant circuit 110. The refrigerant shutoff mechanisms 46 and 24 shut off the flow of the refrigerant from the outdoor unit 102 side to the indoor unit 3 side when the refrigerant in the portion of the refrigerant circuit 110 within the outdoor unit 102 meets the predetermined condition (when the refrigerant meets the condition for a disproportionation reaction to occur). In particular, here, the refrigerant circuit 110 is configured to circulate the refrigerant through, in sequence, the compressor 21, the outdoor heat exchanger 23, the indoor heat exchanger 31, and the compressor 21 (cooling operation). Therefore, when a disproportionation reaction occurs in the portion of the refrigerant circuit 110 within the outdoor unit 102, it is necessary to shut off the flow of the refrigerant from the intake side of the compressor 21 to the indoor unit 3 side and the flow of the refrigerant from the liquid side of the outdoor heat exchanger 23 to the indoor unit 3 side. The refrigerant circuit 110 is also configured to circulate the refrigerant through, in sequence, the compressor 21, the indoor heat exchanger 31, the outdoor heat exchanger 23, and the compressor 21 (heating operation). Therefore, when a disproportionation reaction occurs in the portion of the refrigerant circuit 110 within the outdoor unit 102, it is necessary to shut off the flow of the refrigerant from the discharge side of the compressor 21 to the indoor unit 3 side and the flow of the refrigerant from the liquid side of the outdoor heat exchanger 23 to the indoor unit 3 side. Accordingly, here, the gas-side refrigerant shutoff mechanism 46 and the liquid-side refrigerant shutoff mechanism 24 as described above are provided as refrigerant shutoff mechanisms in the refrigerant circuit 110.

Thus, here, when a disproportionation reaction occurs in the portion of the refrigerant circuit 110 within the outdoor unit 102, it is possible to shut off the flow of the refrigerant from the outdoor unit 102 side to the indoor unit 3 side, thereby inhibiting the propagation of the disproportionation reaction and the resulting pressure rise to the indoor unit 3.

Thus, here, even when the refrigerant undergoes a disproportionation reaction, the devices and pipes that constitute the portion of the refrigerant circuit 110 within the indoor unit 3 can be inhibited from being damaged, thereby reducing the likelihood of the refrigerant being ejected into the indoor space. In particular, here, when a disproportionation reaction occurs in the portion of the refrigerant circuit 110 within the outdoor unit 2 while the refrigerant is being circulated in the refrigerant circuit 110 through, in sequence, the compressor 21, the outdoor heat exchanger 23, the indoor heat exchanger 31, and the compressor 21, the gas-side refrigerant shutoff mechanism 46 and the liquid-side refrigerant shutoff mechanism 24 can shut off the flow of the refrigerant from the outdoor unit 102 side to the indoor unit 3 side. Also, here, when a disproportionation reaction occurs in the portion of the refrigerant circuit 110 within the outdoor unit 2 while the refrigerant is being circulated in the refrigerant circuit 110 through, in sequence, the compressor 21, the indoor heat exchanger 31, the outdoor heat exchanger 23, and the compressor 21, the gas-side refrigerant shutoff mechanism 46 and the liquid-side refrigerant shutoff mechanism 24 can shut off the flow of the refrigerant from the outdoor unit 102 side to the indoor unit 3 side.

It is also possible to provide the refrigerant shutoff mechanisms in the refrigerant connection pipes 4 and 5, rather than in the outdoor unit 102. However, since portions of the refrigerant connection pipes 4 and 5 are disposed inside a building, it is undesirable to provide the refrigerant shutoff mechanisms in the refrigerant connection pipes 4 and 5 in view of the possibility of the refrigerant being ejected into the indoor space due to damage to the refrigerant connection pipes 4 and 5. Thus, it is preferred to provide the refrigerant shutoff mechanisms in the outdoor unit 102.

Here, as described above, the gas-side refrigerant shutoff mechanism is the electromagnetic valve 46. When the refrigerant in the portion of the refrigerant circuit 110 within the outdoor unit 102 meets the predetermined condition (when the refrigerant meets the condition for a disproportionation reaction to occur), the electromagnetic valve 46 can be closed by electrical control to shut off the flow of the refrigerant from the intake side of the compressor 21 or the discharge side of the compressor 21 to the indoor unit 3 side.

Here, as described above, the liquid-side refrigerant shutoff mechanism is the expansion valve 24. The expansion valve 24 is used for decompression while the refrigerant is being circulated in the refrigerant circuit 110. When the refrigerant in the portion of the refrigerant circuit 110 within the outdoor unit 102 meets the predetermined condition (when the refrigerant meets the condition for a disproportionation reaction to occur), the expansion valve 24 can be closed by electrical control to shut off the flow of the refrigerant from the liquid side of the outdoor heat exchanger 23 to the indoor unit 3 side.

If a refrigerant containing HFO-1123 is used as the refrigerant containing a hydrofluorocarbon having the property of undergoing a disproportionation reaction, it can be used as an alternative refrigerant to FC-32 or HFC-410A. Even when the refrigerant undergoes a disproportionation reaction, it can be inhibited that the portion of the refrigerant circuit 10 within the indoor unit 3 is damaged, thereby reducing the likelihood of the refrigerant being ejected into the indoor space.

<First Modification>

Figure 8:
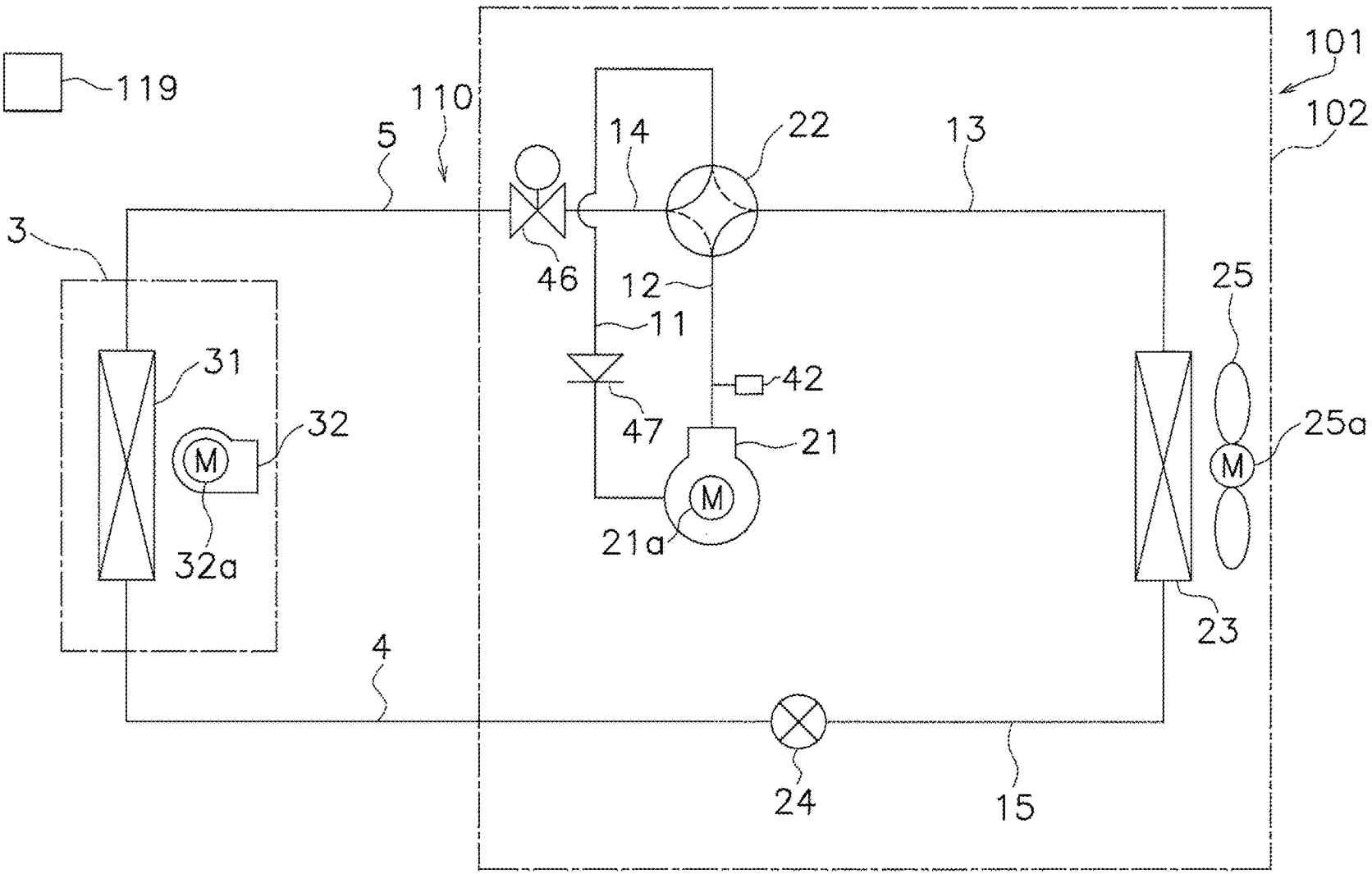
FIG. 8 is a schematic diagram of an air conditioner according to a first modification of the second embodiment of the present invention.

In the configuration of the second embodiment, as shown in FIG. 8, a check valve 47 may be provided in the intake pipe 11. Here, during cooling operation, the check valve 47 functions as a valve mechanism that allows the flow of the refrigerant from the second gas refrigerant pipe 14 to the intake side of the compressor 21 while shutting off the flow of the refrigerant from the intake side of the compressor 21 to the second gas refrigerant pipe 14 side. During heating operation, the check valve 47 functions as a valve mechanism that allows the flow of the refrigerant from the first gas refrigerant pipe 13 to the intake side of the compressor 21 while shutting off the flow of the refrigerant from the intake side of the compressor 21 to the first gas refrigerant pipe 13 side.

In this configuration having the check valve 47 added thereto, during cooling operation, when the refrigerant in the portion of the refrigerant circuit 10 within the outdoor unit 2 meets the predetermined condition (when the refrigerant meets the condition for a disproportionation reaction to occur), the check valve 47 shuts off the flow of the refrigerant from the intake side of the compressor 21 to the second gas refrigerant pipe 14 side. Thus, the check valve 47 functions as the gas-side refrigerant shutoff mechanism that shuts off the flow of the refrigerant from the intake side of the compressor 21 to the indoor unit 3 side. Therefore, the electromagnetic valve 46 need not function as a gas-side refrigerant shutoff mechanism (that is, the electromagnetic valve 46 need not switch from an open state to a fully closed state). Alternatively, both the electromagnetic valve 46 and the check valve 47 may function as the gas-side refrigerant shutoff mechanisms so that they can reliably shut off the flow of the refrigerant from the intake side of the compressor 21 to the indoor unit 3 side.

During heating operation, when the refrigerant in the portion of the refrigerant circuit 10 within the outdoor unit 2 meets the predetermined condition (when the refrigerant meets the condition for a disproportionation reaction to occur), the check valve 47 shuts off the flow of the refrigerant from the intake side of the compressor 21 to the first gas refrigerant pipe 13 side. Thus, the check valve 47 functions as the liquid-side refrigerant shutoff mechanism that shuts off the flow of the refrigerant from the liquid side of the outdoor heat exchanger 23 to the indoor unit 3 side. Therefore, the expansion valve 24 need not function as a liquid-side refrigerant shutoff mechanism (that is, the expansion valve 24 need not switch from an open state to a fully closed state). Alternatively, both the expansion valve 24 and the check valve 47 may function as the liquid-side refrigerant shutoff mechanisms so that they can reliably shut off the flow of the refrigerant from the liquid side of the outdoor heat exchanger 23 to the indoor unit 3 side.

<Second Modification>

Figure 9:
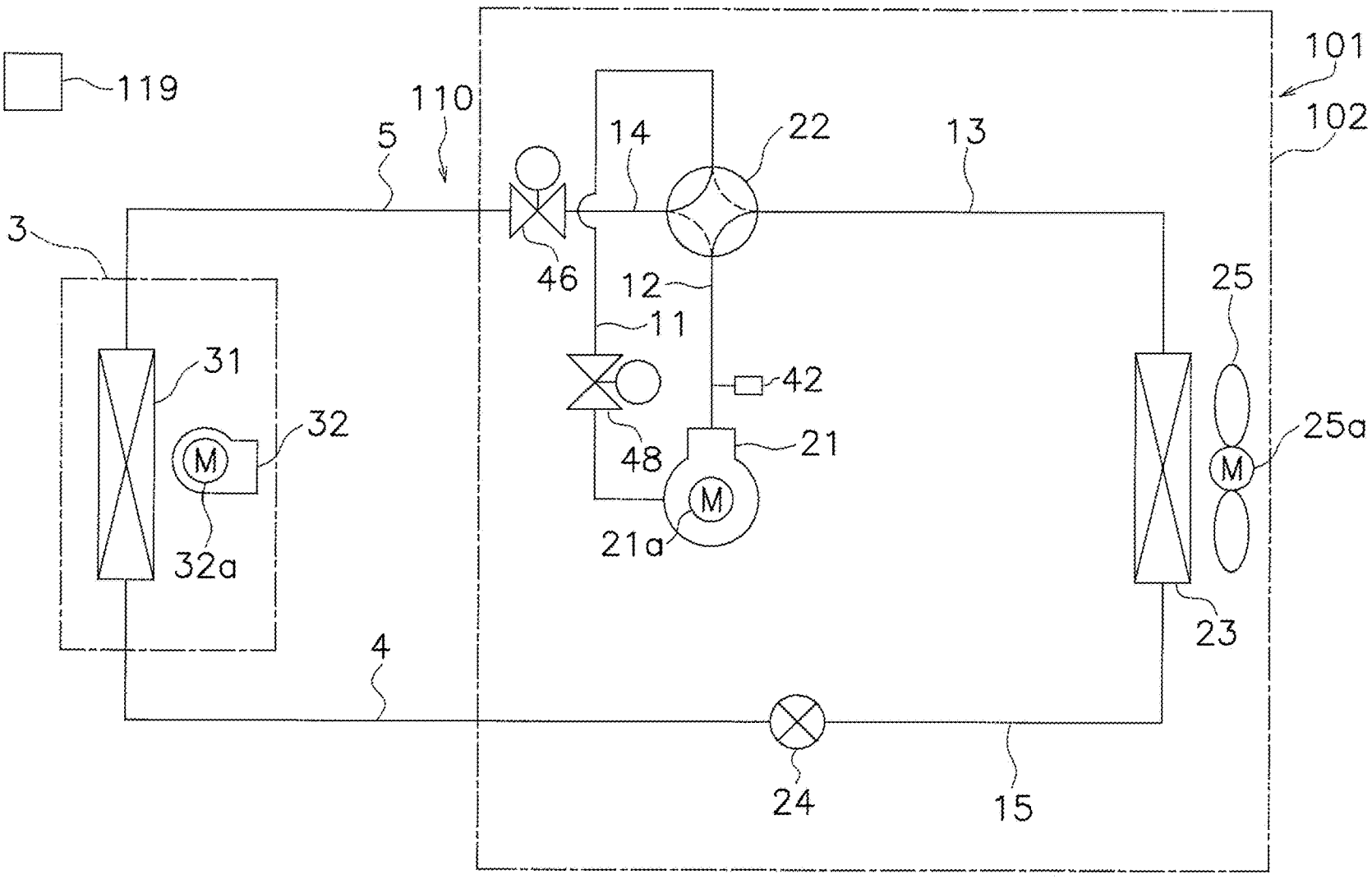
FIG. 9 is a schematic diagram of an air conditioner according to a second modification of the second embodiment of the present invention.

In the configuration of the first modification of the second embodiment, as shown in FIG. 9, the check valve 47 may be replaced by an electromagnetic valve 48 composed of a valve mechanism whose opening and closing state is electrically controlled by the control unit 119.

In this case, during cooling operation, when the refrigerant in the portion of the refrigerant circuit 10 within the outdoor unit 2 meets the predetermined condition (when the refrigerant meets the condition for a disproportionation reaction to occur), the electromagnetic valve 48 switches from an open state to a fully closed state. Thus, as in the first modification, the electromagnetic valve 48 can function as the gas-side refrigerant shutoff mechanism that shuts off the flow of the refrigerant from the intake side of the compressor 21 to the indoor unit 3 side. During heating operation, when the refrigerant in the portion of the refrigerant circuit 10 within the outdoor unit 2 meets the predetermined condition (when the refrigerant meets the condition for a disproportionation reaction to occur), the electromagnetic valve 48 switches from an open state to a fully closed state. Thus, as in the first modification, the electromagnetic valve 48 can function as the liquid-side refrigerant shutoff mechanism that shuts off the flow of the refrigerant from the liquid side of the outdoor heat exchanger 23 to the indoor unit 3 side.

<Third Modification>

In the second embodiment and the first and second modifications, the refrigerant shutoff mechanisms are used as a measure against the disproportionation reaction of the refrigerant. It is preferred to use, in addition to the refrigerant shutoff mechanisms, another measure against the disproportionation reaction of the refrigerant.

Figure 10:
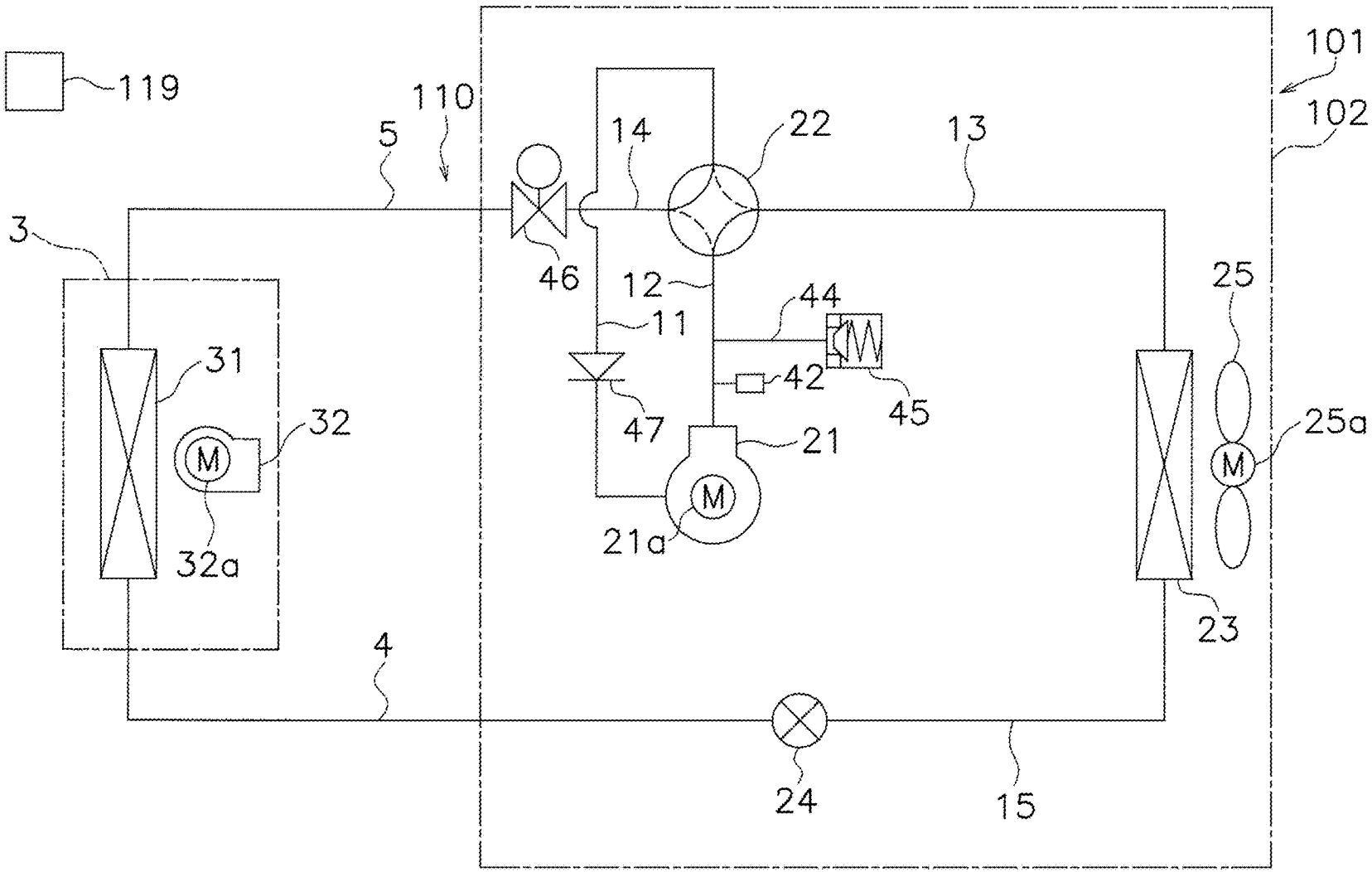
FIG. 10 is a schematic diagram of an air conditioner according to a third modification of the second embodiment of the present invention.

Accordingly, here, as shown in FIG. 10, a relief valve 45 is further provided as a refrigerant relief mechanism, as in the second modification of the first embodiment. The relief valve 45 releases the refrigerant out of the refrigerant circuit 110 when the refrigerant in the portion of the refrigerant circuit 110 within the outdoor unit 102 meets the predetermined condition (when the refrigerant meets the condition for a disproportionation reaction to occur). The configuration of the refrigerant relief mechanism 45 is the same as that of the second modification of the first embodiment; therefore, a description thereof is omitted here.

Thus, here, when the refrigerant in the portion of the refrigerant circuit 110 within the outdoor unit 102 meets the predetermined condition (when the refrigerant meets the condition for a disproportionation reaction to occur), the refrigerant shutoff mechanisms 46, 47, 48, and 24 can shut off the flow of the refrigerant from the outdoor unit 102 side to the indoor unit 3 side, and the refrigerant relief mechanism 45 can release the refrigerant out of the refrigerant circuit 110, thereby further inhibiting the propagation of the disproportionation reaction and the resulting pressure rise to the indoor unit 3.

If a mechanical valve mechanism as described above is provided as the refrigerant relief mechanism 45, a limit switch or other device may be provided on the refrigerant relief mechanism 45 so that it sends an operating signal to the control unit 119 when the refrigerant relief mechanism 45 operates. In response to the operating signal from the refrigerant relief mechanism 45, the control unit 119 may operate the refrigerant shutoff mechanisms 46, 48, and 24 to shut off the flow of the refrigerant from the outdoor unit 102 side to the indoor unit 3 side.

Instead of a mechanical valve mechanism, a valve mechanism that is electrically controlled by the control unit 119, such as an electromagnetic valve, may be used as the refrigerant relief mechanism 45. In this case, as with the refrigerant shutoff mechanisms 46, 48, and 24, when the pressure of the refrigerant on the discharge side of the compressor 21 reaches the threshold pressure PH, the control unit 119 can operate the refrigerant relief mechanism 45 so that it switches from a closed state to an open state.

Figure 11:
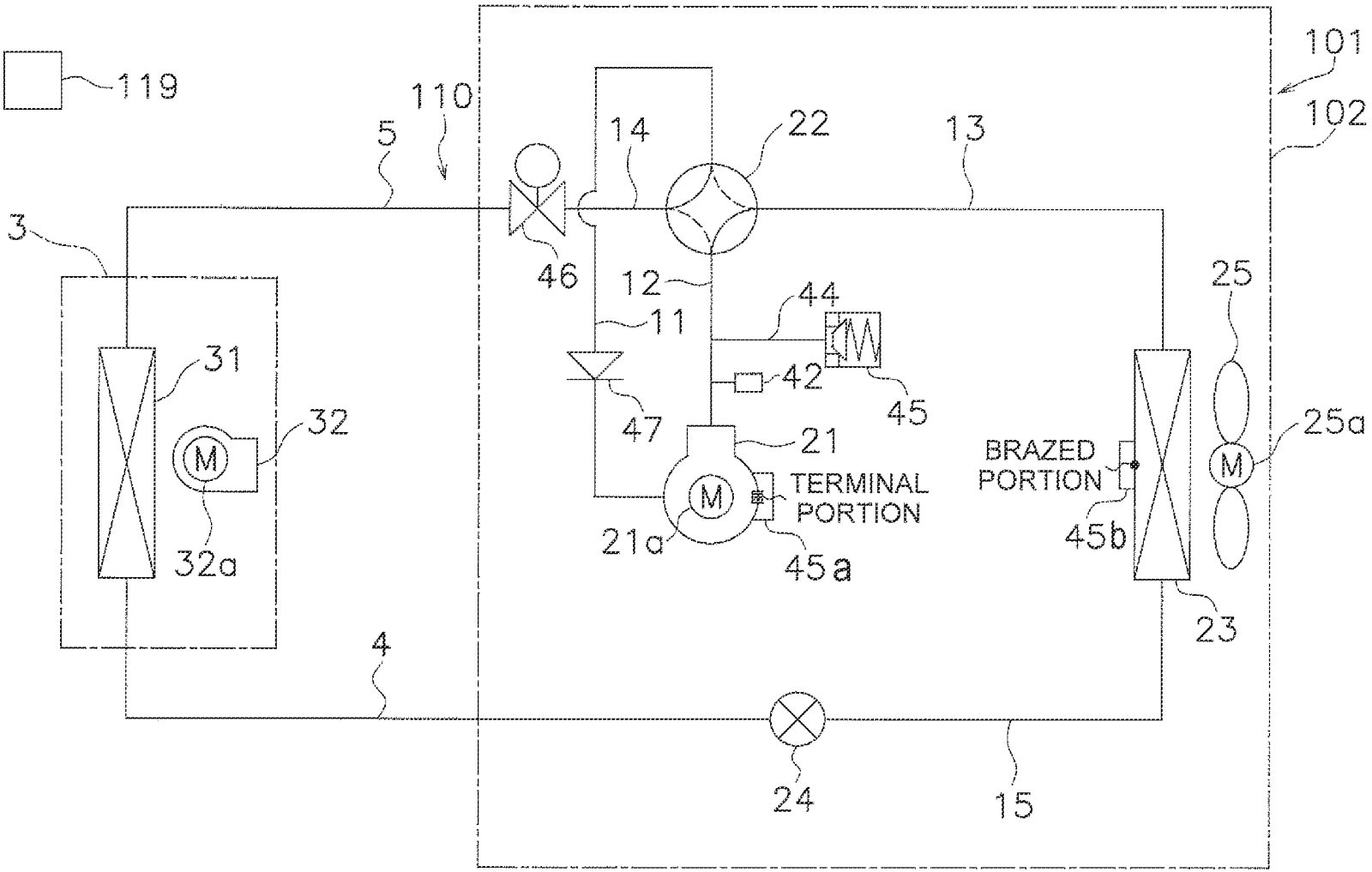
FIG. 11 is a schematic diagram of the air conditioner according to the third modification of the second embodiment of the present invention.

Configurations different from the relief valve disposed on the discharge side of the compressor 21 may also be used as refrigerant relief mechanisms 45. For example, as shown in FIG. 11, the compressor 21 may have a metal terminal cover covering a terminal portion 45*a* of the compressor 21, and the outdoor heat exchanger 23 may have a protective cover covering a brazed portion 45*b* of the outdoor heat exchanger 23, as in the second modification of the first embodiment.

<Fourth Modification>

In the second embodiment and the first and second modifications, the expansion valve 24, which decompresses the refrigerant flowing between the outdoor heat exchanger 23 and the indoor heat exchanger 31, is used as the liquid-side refrigerant shutoff mechanism during cooling operation. However, the liquid-side refrigerant shutoff mechanism is not limited thereto. An additional valve mechanism capable of opening and closing, such as an electromagnetic valve, may be provided as the liquid-side refrigerant shutoff mechanism somewhere in the path of the refrigerant circuit 110 from the discharge side of the compressor 21 through the outdoor heat exchanger 23 and the expansion valve 24 to the liquid-refrigerant connection pipe 4. In this case, when the refrigerant in the portion of the refrigerant circuit 110 within the outdoor unit 2 meets the predetermined condition (when the refrigerant meets the condition for a disproportionation reaction to occur), the control unit 119 can control the additional valve mechanism so that it switches from an open state to a closed state, thereby shutting off the flow of the refrigerant from the liquid side of the outdoor heat exchanger 23 to the indoor unit 3 side.

(3) Other Embodiments

Although examples in which the present invention is applied to a configuration in which the single indoor unit 3 is connected to the outdoor unit 2 or 102 are described in the first and second embodiments and the modifications thereof, the present invention may also be applied to a configuration in which a plurality of indoor units 3 are connected to the outdoor unit 2 or 102.

INDUSTRIAL APPLICABILITY

The present invention is applicable to a wide range of air conditioners having a refrigerant circuit in which a refrigerant containing a hydrofluorocarbon having the property of undergoing a disproportionation reaction is sealed.

REFERENCE SIGNS LIST

1, 101 air conditioner
2, 102 outdoor unit
3 indoor unit
10, 110 refrigerant circuit
19, 119 control unit
21 compressor
23 outdoor heat exchanger
24 expansion valve (liquid-side refrigerant shutoff mechanism)
31 indoor heat exchanger
41 check valve (gas-side refrigerant shutoff mechanism)
43 electromagnetic valve (gas-side refrigerant shutoff mechanism)
45 relief valve (refrigerant relief mechanism)
46 electromagnetic valve (gas-side refrigerant shutoff mechanism)
47 check valve (gas-side refrigerant shutoff mechanism, liquid-side refrigerant shutoff mechanism)
48 electromagnetic valve (gas-side refrigerant shutoff mechanism, liquid-side refrigerant shutoff mechanism)

CITATION LIST

Patent Literature

PTL 1: International Publication No. 2012/157764

The invention claimed is:

1. An air conditioner comprising:

a refrigerant circuit which is formed by connecting an outdoor unit and an indoor unit, the refrigerant circuit having a refrigerant sealed therein, the refrigerant containing a hydrofluorocarbon having a property of undergoing a disproportionation reaction, the refrigerant circuit including a refrigerant shutoff valve that shuts off a flow of the refrigerant from the outdoor unit side to the indoor unit side;

a control unit configured to control the refrigerant shutoff valve such that when the refrigerant in a portion of the refrigerant circuit within the outdoor unit meets a predetermined condition in which the refrigerant undergoes the disproportionation reaction, the refrigerant shutoff valve is closed to prevent the flow of the refrigerant from the outdoor unit side to the indoor unit side.

2. The air conditioner according to claim 1, wherein the outdoor unit includes a compressor and an outdoor heat exchanger, the indoor unit includes an indoor heat exchanger, the refrigerant circuit is configured to circulate the refrigerant through, in sequence, the compressor, the outdoor heat exchanger, the indoor heat exchanger, and the compressor, the refrigerant shutoff valve includes a gas-side refrigerant shutoff valve that shuts off a flow of the refrigerant from an intake side of the compressor to the indoor unit side and a liquid-side refrigerant shutoff valve that shuts off a flow of the refrigerant from a liquid side of the outdoor heat exchanger to the indoor unit side, and the control unit is configured to control at least the liquid-side refrigerant shutoff valve such that the liquid-side refrigerant shutoff valve is closed when the predetermined condition is met.

3. The air conditioner according to claim 2, wherein the gas-side refrigerant shutoff valve is a check valve.

4. The air conditioner according to claim 1, wherein the outdoor unit includes a compressor and an outdoor heat exchanger, the indoor unit includes an indoor heat exchanger, the refrigerant circuit is configured to circulate the refrigerant through, in sequence, the compressor, the indoor heat exchanger, the outdoor heat exchanger, and the compressor, the refrigerant shutoff valve includes a gas-side refrigerant shutoff valve that shuts off a flow of the refrigerant from a discharge side of the compressor to the indoor unit side and a liquid-side refrigerant shutoff valve that shuts off a flow of the refrigerant from a liquid side of the outdoor heat exchanger to the indoor unit side, and the control unit is configured to control the shutoff valve such that both the gas-side refrigerant shutoff valve and the liquid-side refrigerant shutoff valve are closed when the predetermined condition is met.

5. The air conditioner according to claim 2, wherein the gas-side refrigerant shutoff valve is an electromagnetic valve, and the control unit is configured to control the electromagnetic valve such that the electromagnetic valve is closed when the predetermined condition is met.

6. The air conditioner according to claim 2, wherein the liquid-side refrigerant shutoff valve is an expansion valve that decompresses the refrigerant flowing between the outdoor heat exchanger and the indoor heat exchanger.

7. The air conditioner according to claim 1, wherein the refrigerant circuit further includes a refrigerant relief mechanism that releases the refrigerant out of the refrigerant circuit when the refrigerant in the portion of the refrigerant circuit within the outdoor unit meets a predetermined condition.

8. The air conditioner according to claim 7, wherein the outdoor unit includes a compressor, and the refrigerant relief mechanism is a relief valve disposed on a discharge side of the compressor.

9. The air conditioner according to claim 7, wherein the outdoor unit includes a compressor, and the refrigerant relief mechanism is a terminal cover covering a terminal portion of the compressor.

10. The air conditioner according to claim 7, wherein the outdoor unit includes an outdoor heat exchanger, and the refrigerant relief mechanism is a protective cover covering a brazed portion of the outdoor heat exchanger.

11. The air conditioner according to claim 1, wherein the refrigerant contains HFO-1123.

* * * * *